US010995474B2

(12) United States Patent
Takahashi et al.

(10) Patent No.: US 10,995,474 B2
(45) Date of Patent: May 4, 2021

(54) CONSTRUCTION MACHINE

(71) Applicant: Hitachi Construction Machinery Tierra Co., Ltd., Koka (JP)

(72) Inventors: Kiwamu Takahashi, Moriyama (JP); Taihei Maehara, Koka (JP); Takeshi Ishii, Hino-cho (JP)

(73) Assignee: Hitachi Construction Machinery Tierra Co., Ltd, Koka (JP)

( * ) Notice: Subject to any disclaimer, the term of this patent is extended or adjusted under 35 U.S.C. 154(b) by 0 days.

(21) Appl. No.: 16/642,248

(22) PCT Filed: Jan. 10, 2019

(86) PCT No.: PCT/JP2019/000430

§ 371 (c)(1),
(2) Date: Feb. 26, 2020

(87) PCT Pub. No.: WO2019/187489

PCT Pub. Date: Oct. 3, 2019

(65) Prior Publication Data

US 2021/0071391 A1 Mar. 11, 2021

(30) Foreign Application Priority Data

Mar. 28, 2018 (JP) ..... JP2018-063053

(51) Int. Cl.
*E02F 9/22* (2006.01)
*F15B 13/02* (2006.01)
(Continued)

(52) U.S. Cl.
CPC ..... *E02F 9/2203* (2013.01); *E02F 9/2004* (2013.01); *E02F 9/2228* (2013.01);
(Continued)

(58) Field of Classification Search
CPC ..... E02F 9/2203; E02F 9/2235; E02F 9/2004; E02F 9/2228; E02F 9/92267; E02F 9/2271; F14B 2211/6313; F14B 2211/6346
See application file for complete search history.

(56) References Cited

U.S. PATENT DOCUMENTS 5,537,819 A 7/1996 Kobayashi
2007/0006580 A1 1/2007 Hesse
(Continued)

FOREIGN PATENT DOCUMENTS

JP 7-42705 A 2/1995
JP 2007-505270 A 3/2007
(Continued)

OTHER PUBLICATIONS

International Search Report (PCT/ISA/210) issued in PCT Application No. PCT/JP2019/000430 dated Mar. 26, 2019 with English translation (two (2) pages).
(Continued)

*Primary Examiner* — F Daniel Lopez
*Assistant Examiner* — Daniel S Collins
(74) *Attorney, Agent, or Firm* — Crowell & Moring LLP

(57) ABSTRACT

Flow control over a hydraulic pump and flow dividing control of a plurality of directional control valves associated with actuators can stably be exercised even in a case in which differential pressures across the directional control valves are quite low, an abrupt change in a flow rate of the hydraulic fluid supplied to each actuator is prevented and excellent combined operability is realized even in an abrupt change in a demanded flow rate at a time of transition from a combined operation to a sole operation, and realizing excellent combined operability, and a meter-in loss in each directional control valve is reduced to realize high energy
(Continued)

efficiency. Demanded flow rates of the directional control valves are calculated from input amounts of operation levers, openings of flow control valves are controlled using the demanded flow rates, a meter-in pressure loss of a predetermined directional control valve is calculated from the demanded flow rates and meter-in opening areas of the directional control valves, and a set pressure of an unloading valve is controlled using a value of the meter-in pressure loss.

6 Claims, 20 Drawing Sheets

(51) Int. Cl.
*E02F 9/20* (2006.01)
*E02F 3/32* (2006.01)

(52) U.S. Cl.
CPC ..... *E02F 9/2235* (2013.01); *E02F 9/2267* (2013.01); *E02F 9/2271* (2013.01); *E02F 9/2296* (2013.01); *F15B 13/021* (2013.01); *E02F 3/325* (2013.01); *E02F 9/2285* (2013.01); *E02F 9/2292* (2013.01); *F15B 2211/6313* (2013.01)

(56) References Cited

U.S. PATENT DOCUMENTS

2011/0000203 A1* 1/2011 Riedel ..... F15B 11/163 60/327
2015/0040553 A1* 2/2015 Takahashi ..... F15B 11/165 60/430

FOREIGN PATENT DOCUMENTS

JP 2014-98487 A 5/2014
JP 2015-105675 A 6/2015

OTHER PUBLICATIONS

Japanese-language Written Opinion (PCT/ISA/237) issued in PCT Application No. PCT/JP2019/000430 dated Mar. 26, 2019 (four (4) pages).
International Preliminary Report on Patentability (PCT/IB/338 & PCT/IB/373) issued in PCT Application No. PCT/JP2019/000430 dated Oct. 8, 2020, including English translation of document C2 (Japanese-language Written Opinion (PCT/ISA/237) filed on Feb. 26, 2020) (seven (7) pages).

* cited by examiner

CONSTRUCTION MACHINE

TECHNICAL FIELD

The present invention relates to a construction machine such as a hydraulic excavator for carrying out various kinds of work, and particularly relates to a construction machine with a hydraulic drive system that supplies hydraulic fluids delivered from one or more hydraulic pumps to a plurality of, that is, two or more actuators through two or more control valves.

BACKGROUND ART

As a hydraulic control system provided in a construction machine such as a hydraulic excavator, a hydraulic control system based on load sensing control to control a capacity of a variable displacement hydraulic pump in such a manner that a differential pressure between a delivery pressure of the hydraulic pump and a highest load pressure of a plurality of actuators is kept at a certain set value determined in advance, as described in, for example, Patent Document 1, is widely used.

Patent Document 2 describes a hydraulic drive system configured with a variable displacement hydraulic pump, a plurality of actuators, a plurality of throttle orifices controlling a flow rate of a hydraulic fluid supplied from the hydraulic pump to the plurality of actuators, a plurality of pressure compensating valves provided either upstream or downstream of the plurality of throttle orifices, a controller that controls a delivery flow rate of the hydraulic fluid delivered from the hydraulic pump in response to a lever input to an operation lever device and that regulates the plurality of throttle orifices in response to the lever input, and a plurality of pressure sensors that detect load pressures of the plurality of actuators, and configured such that the controller exercises control to fully open the throttle orifice associated with the actuator having a highest load pressure on the basis of pressures detected by the pressure sensors.

Patent Document 3 proposes a drive system configured with a variable displacement hydraulic pump, a plurality of actuators, a plurality of regulating valves each having a throttle function at an intermediate position and supplying a hydraulic fluid delivered from the hydraulic pump to one of the plurality of actuators, an unloading valve provided in a hydraulic fluid supply line of the hydraulic pump, a controller controlling a delivery flow rate of a hydraulic fluid from the hydraulic pump in response to a lever input to an operation lever device, and a pressure sensor detecting a delivery pressure of the hydraulic pump and a load pressure of at least one actuator, and configured such that the controller controls an opening of the regulating valve having the throttle function at the intermediate position in response to a differential pressure between the delivery pressure of the hydraulic pump and the load pressure of the actuator that are detected by the pressure sensor. In this drive system, a set pressure of the unloading valve is set by the highest load pressure of the actuators introduced in a direction of closing the unloading valve and a spring provided in the same direction, and the delivery pressure of the hydraulic pump is controlled not to exceed a value obtained by adding a spring force to the highest load pressure.

PRIOR ART DOCUMENT

Patent Documents

Patent Document 1: JP-2015-105675-A
Patent Document 2: JP-2007-505270-A
Patent Document 3: JP-2014-98487-A

SUMMARY OF THE INVENTION

Problems to be Solved by the Invention

In such conventional load sensing control as disclosed in Patent Document 1, although a differential pressure called LS differential pressure between a delivery pressure or pump pressure of a hydraulic pump and a differential pressure of the highest load pressure, which is caused by a differential pressure across a meter-in opening of each main spool or flow rate control valve, is used for pump flow rate control and flow dividing control of the main spool by a pressure compensating valve, the LS differential pressure is meter-in loss itself and makes one factor that hinders high energy efficiency of the hydraulic system.

Although, in order to increase the energy efficiency of the hydraulic system, it is sufficient if the meter-in final opening of each main spool, namely, the meter-in opening area in full stroke of the main spool, is increased extremely to reduce the LS differential pressure, in current load sensing control, the LS differential pressure cannot be reduced extremely to zero or the like. The reason is such as described below.

The pressure compensating valve that exercises flow dividing control of respective main spools controls the opening of the main spool such that the differential pressure across the main spool is equal to the LS differential pressure. As described above, in a case in which the meter-in final opening of the main spool is extremely large and the LS differential pressure is 0, each pressure compensating valve regulates the opening of the main spool such that the differential pressure across the main spool is equal to 0. In this case, however, a target differential pressure for the pressure compensating valve to determine the opening of the pressure compensating valve is 0. This produces problems that the opening of the pressure compensating valve, that is, a position of a spool in a case of a spool valve or a lift amount of a popet valve in a case of the popet valve is not uniquely determined, pressure control of the pressure compensating valve is unstable, and hunting occurs.

With the structure described in Patent Document 2, the meter-in opening of the actuator having the highest load pressure is controlled to be fully opened; thus, it is possible to eliminate the LS differential pressure that is one of the causes for hindering the improvement in energy efficiency in the conventional load sensing control and to realize a hydraulic system with high energy efficiency.

Moreover, with the structure of Patent Document 2, the pressure compensating valve is designed to set the target differential pressure without using the LS differential pressure; thus, the problem that the control over the pressure compensating valve is unstable does not occur differently from the case of setting the LS differential pressure to 0 in the conventional load sensing control.

However, the conventional technique described in Patent Document 2 has the following problems.

In other words, the throttle orifice (meter-in opening) associated with the actuator having the highest load pressure is always controlled to be fully opened. As a result, in a case, for example, in which an operation on the actuator having a lower load pressure is suddenly stopped in a state in which the actuator having the highest load pressure and the actuator having the lower load pressure are simultaneously operated, it takes some fixed time to reduce a flow rate of the delivered hydraulic fluid due to a limit to responsiveness to hydraulic pump flow control.

In such a case, since the throttle orifice of the highest load pressure actuator is controlled to be opened to a maximum degree, the hydraulic fluid delivered from the hydraulic pump flows into the highest load pressure actuator without being throttled by the opening of the throttle orifice; thus, a speed of the highest load pressure actuator often suddenly increases.

In a case in which the operation lever of the highest load pressure actuator is in full operation, an operating speed of the actuator is originally high, and a flow rate at which the hydraulic fluid is supplied is high, an influence of the actuator on a behavior of a work machine is relatively small. However, in a case in which the operation lever of the highest load pressure actuator is in half operation, an influence of a sudden increase in the flow rate at which the hydraulic fluid is supplied to the actuator and which is originally small is not negligible, often resulting in occurrence of an unpleasant shock to an operator of the work machine.

With the structure described in Patent Document 3, the hydraulic fluid from the hydraulic pump supplied in response to each lever input can be diverted only with a plurality of regulating valves without using the pressure compensating valve; thus, it is possible to reduce a cost of the hydraulic system.

Furthermore, with the structure described in Patent Document 3, the openings of the plurality of regulating valves are computed and determined within an electronic controller on the basis of the target flow rate which is set in response to each operation lever and at which the hydraulic fluid is supplied to each actuator and the differential pressure between the pump pressure and the highest load pressure detected by the pressure sensor; thus, the problem that the control over the pressure compensating valve is unstable does not occur differently in the case of setting the LS differential pressure to 0 in the conventional load sensing control.

Nevertheless, the conventional technique described in Patent Document 3 has the following problems.

In other words, while the unloading valve is provided in the hydraulic fluid supply line from the hydraulic pump as described above, the set pressure of the unloading valve is set by the highest load pressure and a spring force.

On the other hand, the openings (meter-in openings) of the plurality of regulating valves are determined by the differential pressure between the pump pressure and the actuator load pressure and the target flow rate of each actuator set in response to each operation lever; thus, the pump pressure is often higher than the highest load pressure by as much as a pressure loss in the regulating valve associated with the highest load pressure actuator.

However, the set pressure of the unloading valve is set only on the basis of the highest load pressure and the spring force. As a result, in a case, for example, in which the pressure loss in the regulating valve associated with the highest load pressure actuator is high as described above, then the pump pressure exceeds the pressure set by the highest load pressure and the spring force, the unloading valve is at an open position, the hydraulic fluid supplied from the hydraulic pump is often discharged to a tank. The hydraulic fluid discharged by the unloading valve is a useless bleed-off loss, often causing a reduction in energy efficiency of the hydraulic system.

On the other hand, it is possible to set high the spring force of the unloading valve (set high the set pressure thereof) to prevent occurrence of a situation in which the pressure loss in the regulating valve associated with the highest load pressure actuator is high and the pump pressure exceeds the set pressure of the unloading valve, and the useless bleed-off loss occurs. However, in the case, for example, in which a lever operation on one actuator is suddenly stopped from a state in which two or more actuators are simultaneously operated, it is impossible to suppress a sudden increase in the pump pressure since control over the hydraulic pump to reduce the flow rate thereof is late for the sudden increase by the unloading valve. As a result, as in the case of using the conventional technique described in Patent Document 2, an unpleasant shock often occurs to the operator.

An object of the present invention is to provide a construction machine provided with a hydraulic drive system that comprises a variable displacement hydraulic pump and supplies a hydraulic fluid delivered from the hydraulic pump is supplied to a plurality of actuators through a plurality of directional control valves to drive the plurality of actuators, in which (1) even in a case in which the differential pressure across a directional control valve associated with each of the actuators is very low, flow dividing control of the plurality of directional control valves can be performed in a stable state; (2) even in a case in which a demanded flow rate suddenly changes at the time of transition from a combined operation to a single operation or the like, a bleed-off loss of useless discharge of the hydraulic fluid from an unloading valve to a tank is suppressed to minimum to suppress a reduction in energy efficiency, and a sudden change in each actuator speed caused by an abrupt change in a flow rate of the hydraulic fluid to be supplied to each actuator is prevented to suppress occurrence of an unpleasant shock, thereby to realize excellent combined operability, and (3) a meter-in loss in each directional control valve can be reduced to realize high energy efficiency.

Means for Solving the Problems

To attain the object, according to the present invention, there is provided a construction machine provided with a hydraulic drive system comprising: a variable displacement hydraulic pump; a plurality of actuators driven by a hydraulic fluid delivered from the hydraulic pump; a control valve device that distributes and supplies the hydraulic fluid delivered from the hydraulic pump to the plurality of actuators; a plurality of operation lever devices that instructs drive directions and speeds of the plurality of actuators, respectively; a pump regulating device that controls a delivery flow rate of the hydraulic fluid from the hydraulic pump in such a manner that the hydraulic fluid is delivered at a flow rate to match with input amounts of operation levers of the plurality of operation lever devices; an unloading valve that discharges the hydraulic fluid in a hydraulic fluid supply line of the hydraulic pump to a tank when a pressure in the hydraulic fluid supply line of the hydraulic pump exceeds a set pressure determined by adding at least a target differential pressure to a highest load pressure of the plurality of actuators; a plurality of first pressure sensors that detect load pressures of the plurality of actuators, respectively; and a controller that controls the control valve device, wherein the control valve device includes a plurality of directional control valves that are changed over by the plurality of operation lever devices and are associated with the plurality of actuators so as to control the drive directions and the speeds of the actuators, respectively, and a plurality of flow control valves disposed between the hydraulic fluid supply line of the hydraulic pump and the plurality of directional control valves to control flow rates of the hydraulic fluid supplied to the plurality of directional control valves by changing opening areas of the flow control valves, respectively, and the controller is configured to: compute demanded flow rates of the plurality of actuators on the basis of input amounts of the operation levers of the plurality of operation lever devices and compute differential pressures between a highest load pressure of the plurality of actuators and the load pressures of the plurality of actuators, compute target opening areas of the plurality of flow control valves on the basis of the demanded flow rates of the plurality of actuators and the differential pressures and control opening areas of the plurality of flow control valves in such a manner that the opening areas are equal to the target opening areas, and compute meter-in opening areas of the plurality of directional control valves on the basis of the input amounts of the operation levers of the plurality of operation lever devices, compute a meter-in pressure loss of a specific directional control valve out of the plurality of directional control valve on the basis of the meter-in opening areas and the demanded flow rates of the plurality of actuators, and output the pressure loss as the target differential pressure to control the set pressure of the unloading valve.

In this way, according to the present invention, the controller is configured to compute the demanded flow rates of the plurality of directional control valves and the differential pressures between the highest load pressure and the load pressures of the plurality of actuators, compute the target opening areas of the plurality of flow control valves on the basis of the demanded flow rates and the differential pressures, and control the opening areas of the plurality of flow control valves in such a manner that the opening areas are equal to the target opening areas. Thus, the openings of the flow control valves associated with the actuators are controlled to be equal to the values uniquely determined by the demanded flow rate of the hydraulic pump computed from the input amounts of the operation levers at the time and the differential pressures between the highest load pressure and the load pressures of the actuators, without hydraulic feedback of the differential pressures across the meter-in openings of the directional control valves associated with the actuators. As a result, even in a case in which the differential pressure across a directional control valve associated with each of the actuators is very low, flow dividing control of the plurality of directional control valves can be performed in a stable state.

Further, according to the present invention, the controller is configured to compute the meter-in opening area of the specific directional control valve among the plurality of directional control valves on the basis of the input amounts of the operation levers of the plurality of operation lever devices, compute the meter-in pressure loss of the specific directional control valve on the basis of this meter-in opening area and the demanded flow rate of the specific directional control valve, and output this pressure loss as the target differential pressure to control the set pressure of the unloading valve. Thus, the set pressure of the unloading valve is controlled to be equal to the value determined by adding at least the target differential pressure corresponding to the meter-in pressure loss to the highest load pressure, and therefore in a case of throttling the meter-in opening of the specific directional control valve by a half operation of the operation lever, the set pressure of the unloading valve is finely controlled in response to the pressure loss of the meter-in opening of the directional control valve. As a result, even in a case in which a demanded flow rate suddenly changes at the time of transition from a combined operation to a single operation or the like, a bleed-off loss of useless discharge of the hydraulic fluid from an unloading valve to a tank is suppressed to minimum to suppress a reduction in energy efficiency, and further a sudden change in each actuator speed caused by an abrupt change in a flow rate of the hydraulic fluid to be supplied to each actuator is prevented and occurrence of an unpleasant shock is suppressed, thereby to realize excellent combined operability.

Moreover, according to the present invention, since even in the case in which the differential pressures across the directional control valves are very low as described above, flow dividing control of the plurality of directional control valves can be performed in a stable state and the set pressure of the unloading valve is finely controlled in response to the pressure loss of the meter-in opening of the directional control valve, it is possible to set extremely large the meter-in final openings (meter-in opening area in a full stroke of each main spool) of the directional control valves, and therefore a meter-in loss in each directional control valve can be reduced to realize high energy efficiency.

Advantages of the Invention

According to the present invention, in a construction machine provided with a hydraulic drive system that comprises a variable displacement hydraulic pump and supplies a hydraulic fluid delivered from the hydraulic pump is supplied to a plurality of actuators through a plurality of directional control valves to drive the plurality of actuators, (1) even in a case in which the differential pressure across a directional control valve associated with each of the actuators is very low, flow dividing control of the plurality of directional control valves can be performed in a stable state;

(2) even in a case in which a demanded flow rate suddenly changes at the time of transition from a combined operation to a single operation or the like, a bleed-off loss of useless discharge of the hydraulic fluid from an unloading valve to a tank is suppressed to minimum to suppress a reduction in energy efficiency, and a sudden change in each actuator speed caused by an abrupt change in a flow rate of the hydraulic fluid to be supplied to each actuator is prevented and occurrence of an unpleasant shock is suppressed, thereby to realize excellent combined operability, and (3) a meter-in loss in each directional control valve can be reduced to realize high energy efficiency.

MODES FOR CARRYING OUT THE INVENTION

Embodiments of the present invention will be described hereinafter with reference to the drawings.

Embodiment 1

A hydraulic drive system provided in a construction machine according to Embodiment 1 of the present invention will be described with reference to FIGS. 1 to 15.

~Structure~

Figure 1:
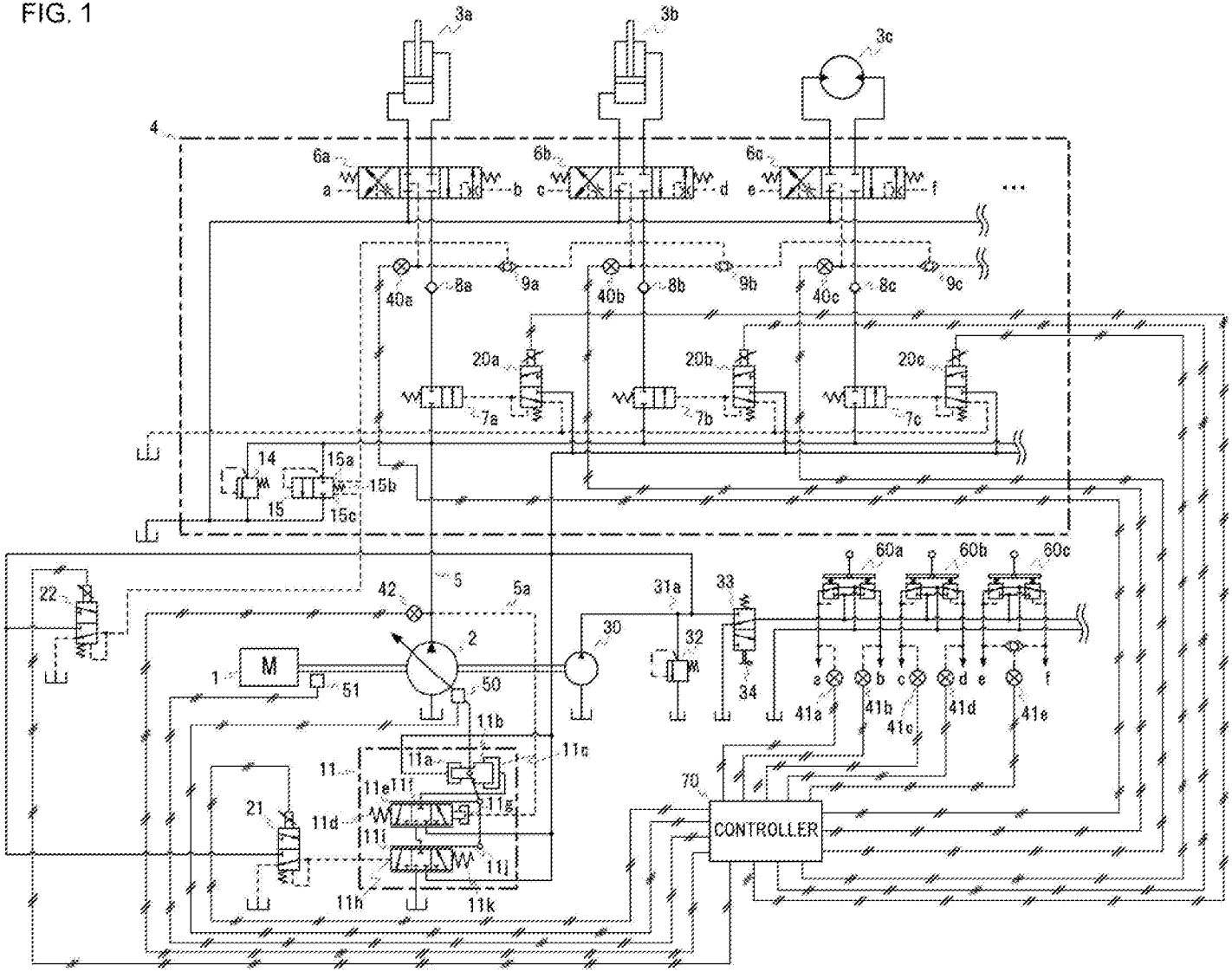
FIG. 1 is a diagram depicting a structure of a hydraulic drive system provided in a construction machine according to Embodiment 1 of the present invention.

FIG. 1 is a diagram depicting a structure of the hydraulic drive system provided in the construction machine according to Embodiment 1 of the present invention.

In FIG. 1, the hydraulic drive system according to Embodiment 1 is configured with a prime mover 1, a main pump 2 that is a variable displacement hydraulic pump driven by the prime mover 1, a fixed displacement pilot pump 30, a plurality of actuators that are a boom cylinder 3*a*, an arm cylinder 3*b*, a swing motor 3*c*, a bucket cylinder 3*d* (refer to FIG. 4), a swing cylinder 3*e* (refer to FIG. 4), travel motors 3*f* and 3*g* (refer to FIG. 4), and a blade cylinder 3*h* (refer to FIG. 4) driven by a hydraulic fluid delivered from the main pump 2, a hydraulic fluid supply line 5 for introducing the hydraulic fluid delivered from the main pump 2 to the plurality of actuators 3*a*, 3*b*, 3*c*, 3*d*, 3*f*, 3*g*, and 3*h*, and a control valve block 4 which is connected to a downstream side of the hydraulic fluid supply line 5 and to which the hydraulic fluid delivered from the main pump 2 is introduced. The "actuators 3*a*, 3*b*, 3*c*, 3*d*, 3*f*, 3*g*, and 3*h*" will be simply denoted as "actuators 3*a*, 3*b*, and 3*c*," hereinafter.

Within the control valve block 4, a plurality of directional control valves 6*a*, 6*b*, and 6*c*, a plurality of check valves 8*a*, 8*b*, and 8*c*, and a plurality of flow control valves 7*a*, 7*b*, and 7*c* for controlling the plurality of actuators 3*a*, 3*b*, and 3*c* are disposed in an order of the flow control valves 7*a*, 7*b*, and 7*c*, the check valves 8*a*, 8*b*, and 8*c*, and the directional control valves 6*a*, 6*b*, and 6*c* from the hydraulic fluid supply line 5. Furthermore, solenoid proportional pressure reducing valves 20*a*, 20*b*, and 20*c* are disposed within the control valve block 4, springs are provided in the flow control valves 7*a*, 7*b*, and 7*c* each in a direction of changing over the flow control valve to be closed, and output pressures from the solenoid proportional pressure reducing valves 20*a*, 20*b*, and 20*c* are introduced in a direction of changing over the flow control valves 7*a*, 7*b*, and 7*c* to be opened.

The plurality of directional control valves 6*a*, 6*b*, and 6*c* and the plurality of flow control valves 7*a*, 7*b*, and 7*c* configure a control valve device that distributes and supplies the hydraulic fluid delivered from the main pump 2 to the plurality of actuators 3*a*, 3*b*, and 3*c*.

Moreover, within the control valve block 4, a relief valve 14 that discharges the hydraulic fluid in the hydraulic fluid supply line 5 to a tank in a case in which a pressure of the relief valve 14 is equal to or higher than a preset set pressure, and an unloading valve 15 that discharges the hydraulic fluid in the hydraulic fluid supply line 5 to the tank in a case in which a pressure of the unloading valve 15 is equal to or higher than a certain set pressure.

Furthermore, within the control valve block 4, shuttle valves 9*a*, 9*b*, and 9*c* connected to load pressure detection ports of the plurality of directional control valves 6*a*, 6*b*, and 6*c* are disposed. The shuttle valves 9*a*, 9*b*, and 9*c* are used for detecting a highest load pressure of the plurality of actuators 3*a*, 3*b*, and 3*c* and configure a highest load pressure sensor. The shuttle valve 9*a*, 9*b*, and 9*c* are connected to one another in a tournament form, and the uppermost shuttle valve 9*a* detects the highest load pressure.

Figure 2:
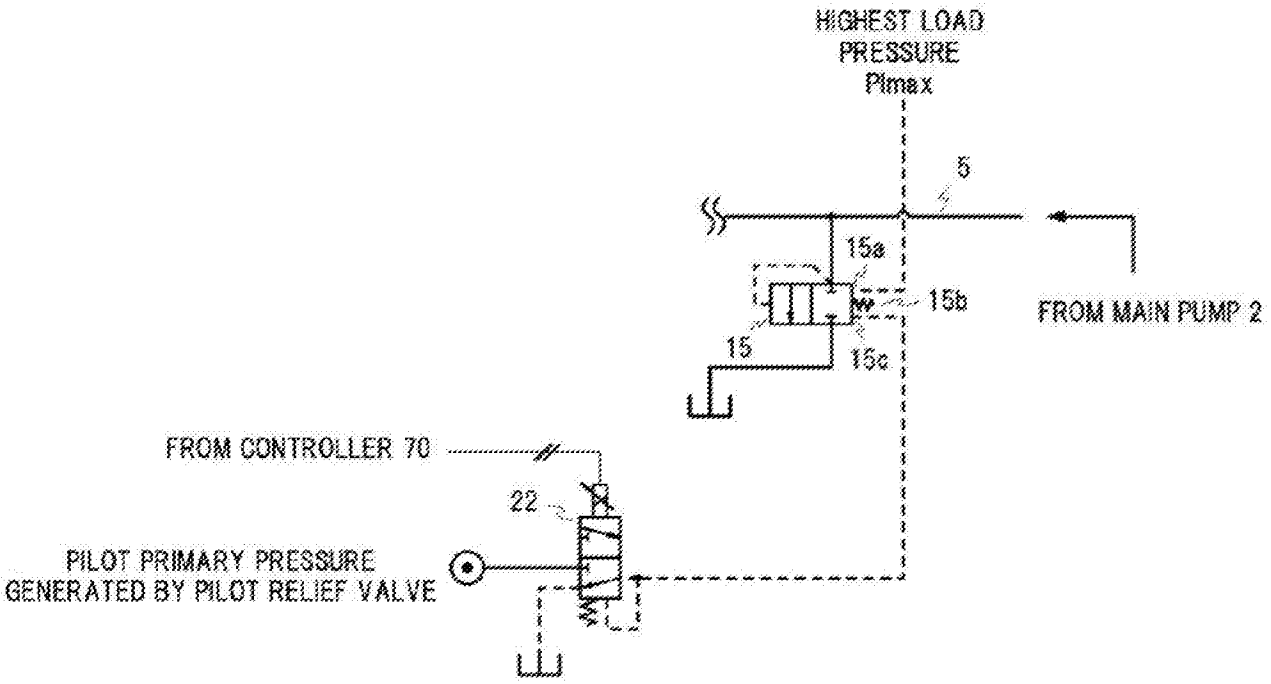
FIG. 2 is an enlarged view of peripheral parts of an unloading valve in the hydraulic drive system according to Embodiment 1.

FIG. 2 is an enlarged view of peripheral parts of the unloading valve. The unloading valve 15 is configured with a pressure receiving section 15*a* to which the highest load pressure of the actuators 3*a*, 3*b*, and 3*c* is introduced in a direction of closing the unloading valve 15, and a spring 15*b*. Furthermore, a solenoid proportional pressure reducing valve 22 for generating a control pressure over the unloading valve 15 is provided, and the unloading valve 15 is configured with a pressure receiving section 15*c* to which an output pressure (control pressure) from the solenoid proportional pressure reducing valve 22 is introduced in the direction of closing the unloading valve 15.

The hydraulic drive system according to Embodiment 1 is also configured with a regulator 11 associated with the main pump 2 and controlling a capacity of the main pump 2, and a solenoid proportional pressure reducing valve 21 generating a command pressure to the regulator 11.

Figure 3:
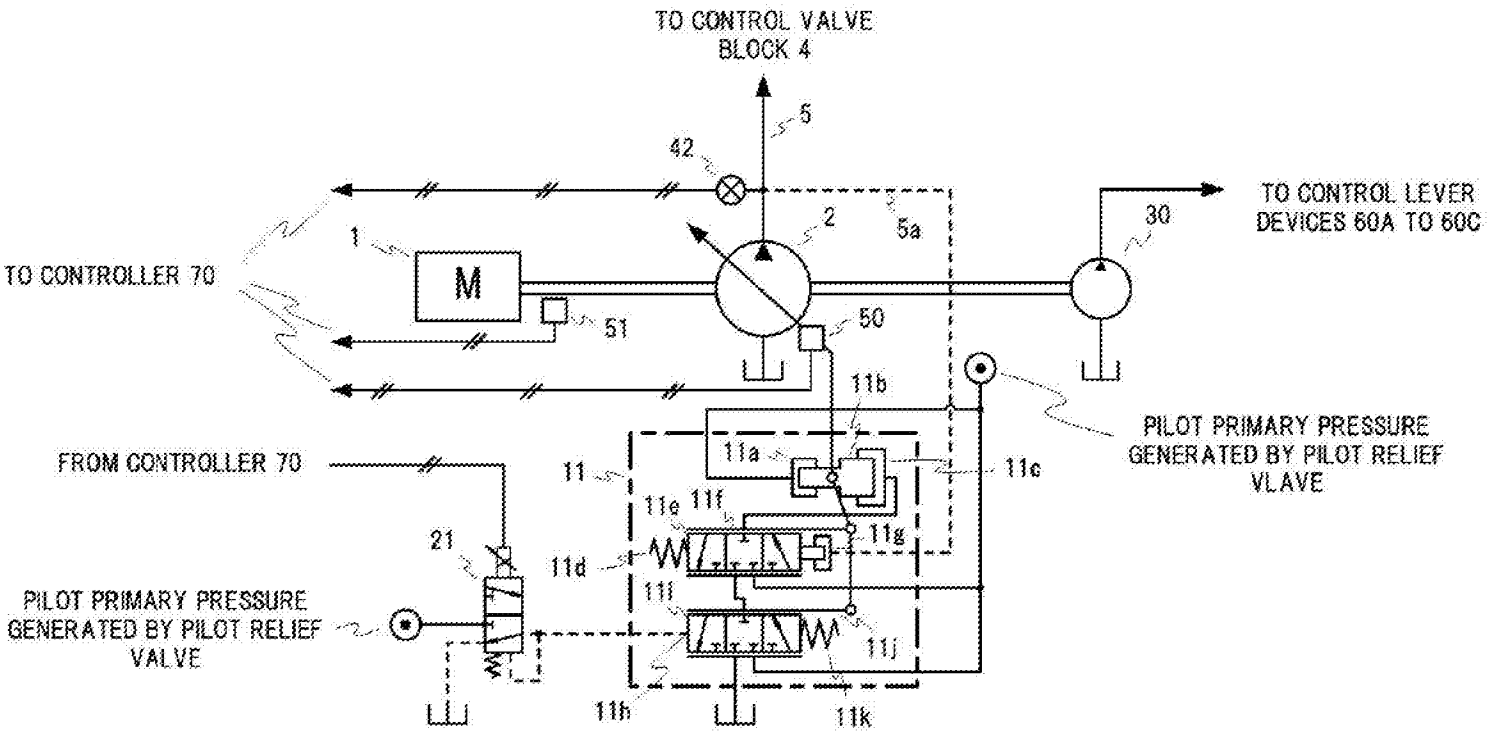
FIG. 3 is an enlarged view of peripheral parts of a main pump including a regulator in the hydraulic drive system according to Embodiment 1.

FIG. 3 is an enlarged view of peripheral parts of the main pump including the regulator 11. The regulator 11 is configured with a differential piston 11*b* driven by a pressure receiving area difference, a horsepower control tilting control valve 11*e*, and a flow control tilting control valve 11*i*, and is configured in such a manner that a large-diameter pressure receiving chamber 11*c* of the differential piston 11*b* is connected to either a hydraulic line 31*a* (pilot hydraulic fluid source) that is a hydraulic fluid supply line of the pilot pump 30 or the flow control tilting control valve 11*i* through the horsepower control tilting control valve 11*e*, and a small-diameter pressure receiving chamber 11*a* is always connected to the hydraulic line 31*a*, and the flow control tilting control valve 11*i* introduces a pressure in the hydraulic line 31*a* or a tank pressure to the horsepower control tilting control valve 11*e*.

The horsepower control tilting control valve 11*e* has a sleeve 11*f* moved together with the differential piston 11*b*, a spring 11*d* located on a side of communicating the flow control tilting control valve 11*i* with the large-diameter pressure receiving chamber 11*c* of the differential piston 11*b*, and a pressure receiving chamber 11*g* to which the pressure of the hydraulic fluid supply line 5 of the main pump 2 is introduced through a hydraulic line 5*a* in a direction of communicating the hydraulic line 31*a* with the small-diameter pressure receiving chamber 11*a* and the large-diameter pressure receiving chamber 11*c* of the differential piston 11*b*.

The flow control tilting control valve 11*i* has a sleeve 11*j* moved together with the differential piston 11*b*, a pressure receiving section 11*h* to which an output pressure (control pressure) from the solenoid proportional pressure reducing valve 21 is introduced in a direction of discharging a hydraulic fluid of the horsepower control tilting control valve 11*e* to the tank, and a spring 11*k* located on a side of introducing a hydraulic fluid in the hydraulic line 31*a* is introduced to the horsepower control tilting control valve 11*e*.

When the large-diameter pressure receiving chamber 11*c* communicates with the hydraulic line 31*a* through the horsepower control tilting control valve 11*e* and the flow control tilting control valve 11*i*, the differential piston 11*b* moves leftward in FIG. 3 by the pressure receiving area difference. When the large-diameter pressure receiving chamber 11*c* communicates with the tank through the horsepower control tilting control valve 11*e* and the flow control tilting control valve 11*i*, the differential piston 11*b* moves rightward in FIG. 3 by a force received from the small-diameter pressure receiving chamber 11*a*. When the differential piston 11*b* moves leftward in FIG. 3, a tilting angle, that is, a pump capacity of the variable displacement main pump 2 are reduced and a delivery flow rate from the main pump 2 is reduced. When the differential piston 11*b* moves rightward in FIG. 3, the tilting angle and the pump capacity of the main pump 2 are increased and the delivery flow rate from the main pump 2 is increased.

A pilot relief valve 32 is connected to a hydraulic fluid supply line (hydraulic line 31*a*) of the pilot pump 30, and the pilot relief valve 32 generates a constant pilot pressure (Pi0) in the hydraulic line 31*a*.

Pilot valves of a plurality of operation lever devices 60*a*, 60*b*, and 60*c* for controlling the plurality of directional control valves 6*a*, 6*b*, and 6*c* are connected to a downstream side of the pilot relief valve 32 through a selector valve 33, and the selector valve 33 is changed over to supply of the pilot pressure (Pi0) generated by the pilot relief valve 32 to the pilot valves of the plurality of operation lever devices 60*a*, 60*b*, and 60*c* as a pilot primary pressure or to discharge of hydraulic fluids of the pilot valves to the tank by operating the selector valve 33 by a gate lock lever 24 provided in a driver's seat 521 (refer to FIG. 4) of the construction machine such as the hydraulic excavator.

The hydraulic drive system according to Embodiment 1 is further configured with pressure sensors 40*a*, 40*b*, and 40*c* for detecting load pressures of the plurality of actuators 3*a*, 3*b*, and 3*c*, pressure sensors 41*a* and 41*b* for detecting operating pressures a and b of the pilot valve of the operation lever device 60*a* for the boom cylinder 3*a*, pressure sensors 41*c* and 41*d* for detecting operating pressures c and d of the pilot valve of the operation lever device 60*b* for the arm cylinder 3*b*, a pressure sensor 41*e* for detecting an operating pressure e of the pilot valve of the operation lever device 60*c* for the swing motor 3*c*, pressure sensors, not depicted, for detecting operating pressures of the pilot valves of operation lever devices for the other actuators, not depicted, a pressure sensor 42 for detecting a pressure of the hydraulic fluid supply line 5 of the main pump 2 (delivery pressure of the main pump 2), a tilting angle sensor 50 detecting a tilting angle of the main pump 2, a revolution speed sensor 51 for detecting a revolution speed of the prime mover 1, and a controller 70.

The controller 70 is configured from a microcomputer provided with, for example, a storage section formed from a CPU, a ROM (Read Only Memory), a RAM (Random Access Memory), a flash memory, and the like, peripheral circuits of the microcomputer, and the like, and is actuated in accordance with, for example, a program stored in the ROM.

Detection signals of the pressure sensors 40*a*, 40*b*, 40*c*, the pressure sensors 41*a*, 41*b*, 41*c*, 41*d*, and 41*e*, the pressure sensor 42, the tilting angle sensor 50, and the revolution speed sensor 51 are input to the controller 70, and the controller 70 outputs control signals to the solenoid proportional pressure reducing valves 20*a*, 20*b*, and 20*c* and the solenoid proportional pressure reducing valves 21 and 22.

Figure 4:
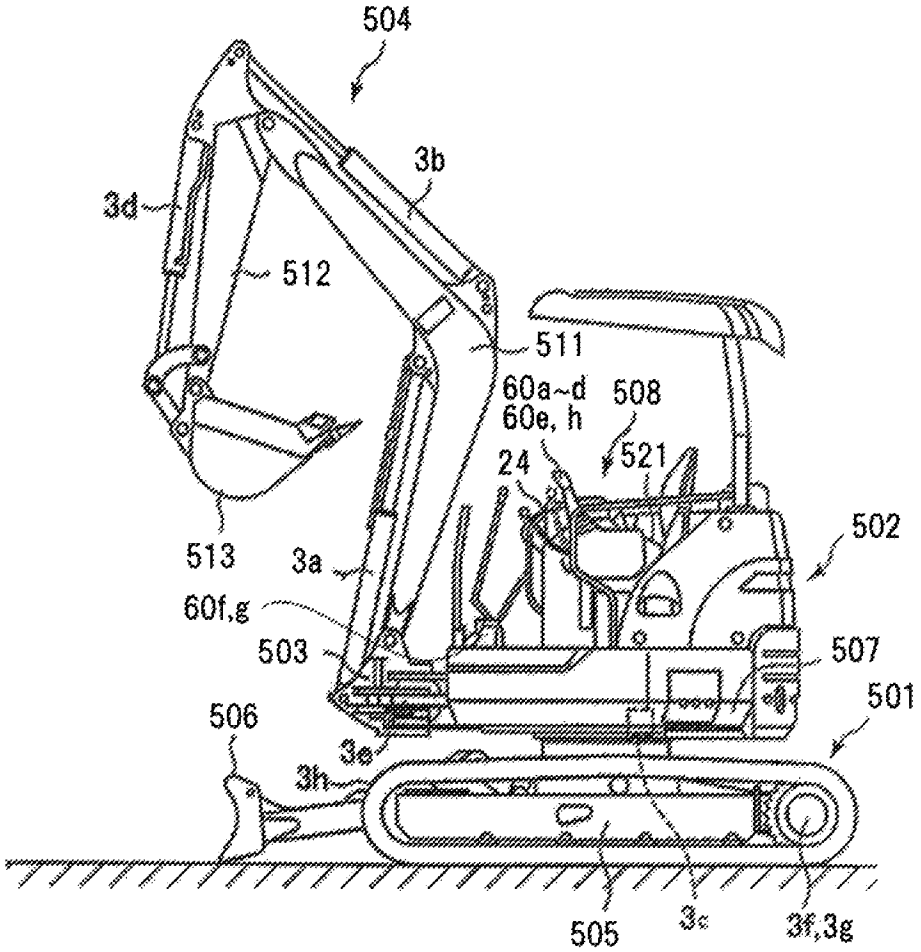
FIG. 4 is a diagram depicting an outward appearance of a hydraulic excavator that is a representative example of the construction machine according to the present invention.

FIG. 4 depicts an outward appearance of the hydraulic excavator in which the hydraulic drive system described above is mounted.

The hydraulic excavator is configured with an upper swing structure 502, a lower travel structure 501, and a swing type front work implement 504, and the front work implement 504 is configured from a boom 511, an arm 512, and a bucket 513. The upper swing structure 502 is swingable with respect to the lower travel structure 501 by rotation of the swing motor 3*c*. A swing post 503 is attached to a front portion of the upper swing structure, and the front work implement 504 is attached to the swing post 503 in a vertically movable manner. The swing post 503 is rotatable in a horizontal direction with respect to the upper swing structure 502 by expansion and contraction of the swing cylinder 3*e*, and the boom 511, the arm 512, and the bucket 513 of the front work implement 504 are vertically rotatable by expansion and contraction of the boom cylinder 3*a*, the arm cylinder 3*b*, and the bucket cylinder 3*d*. A blade 506 vertically operating by expansion and contraction of the blade cylinder 3*h* is attached to a central frame 505 of the lower travel structure 501. The lower travel structure 501 travels by driving left and right crawler belts by rotation of the travel motors 3*f* and 3*g*.

A cabin 508 is installed in the upper swing structure 502, and the driver's seat 521, the operation lever devices 60*a*, 60*b*, 60*c*, and 60*d* provided in left and right front portions of the driver's seat 521 and operating the boom cylinder 3*a*, the arm cylinder 3*b*, the bucket cylinder 3*d*, and the swing motor 3*c*, the operation lever device 60*e* operating the swing cylinder 3*e*, the operation lever device 60*h* operating the blade cylinder 3*h*, the operation lever devices 60*f* and 60*g* operating the travel motors 3*f* and 3*g*, and the gate lock lever 24 are provided within the cabin 508.

Figure 5:
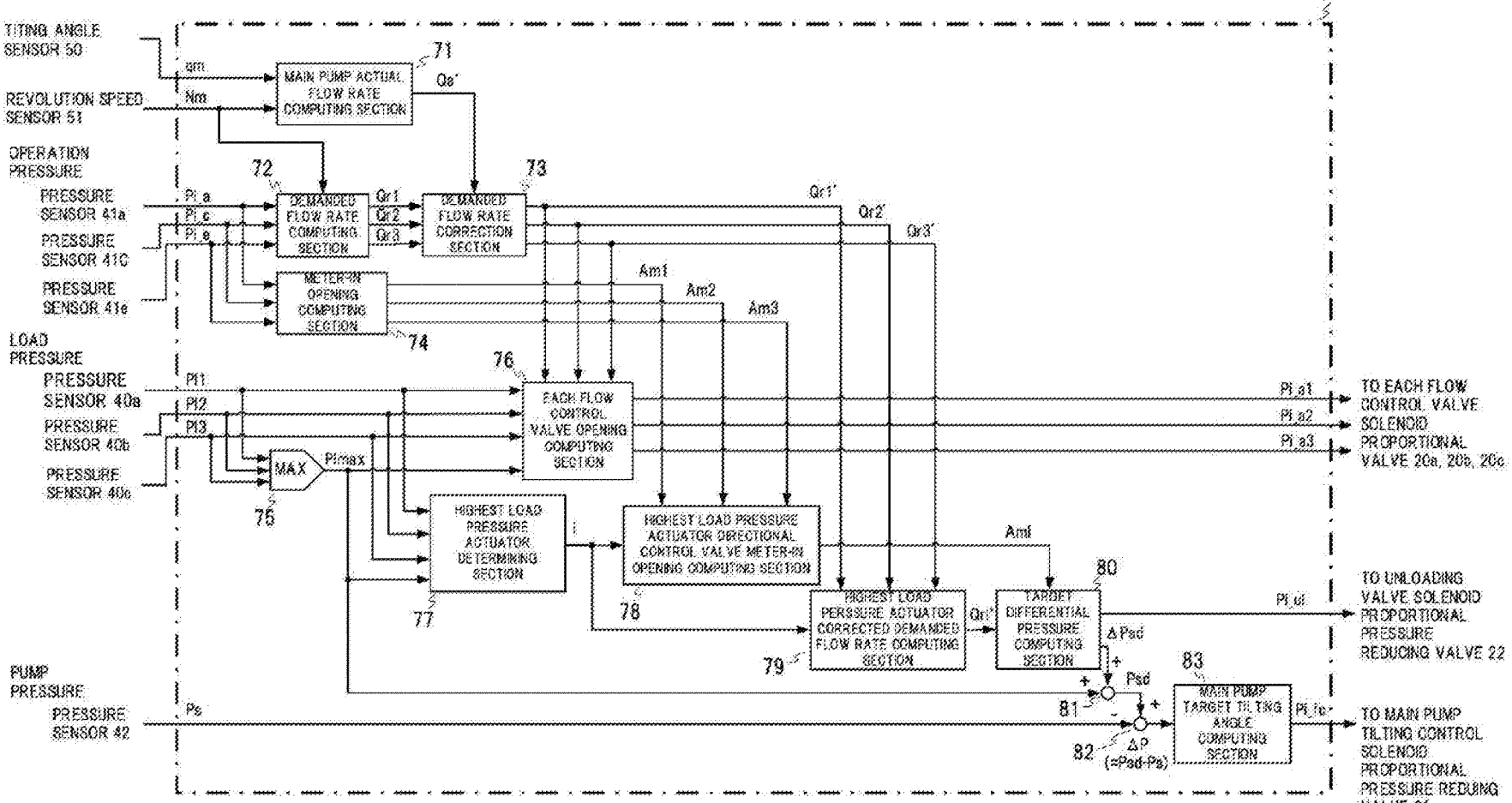
FIG. 5 is a functional block diagram of a controller in the hydraulic drive system according to Embodiment 1.

FIG. 5 depicts a functional block diagram of the controller 70 in the hydraulic drive system depicted in FIG. 1.

An output from the tilting angle sensor 50 indicating the tilting angle of the main pump 2 and an output from the revolution speed sensor 51 indicating the revolution speed of the prime mover 1 are input to a main pump actual flow rate computing section 71, the output from the revolution speed sensor 51 and outputs from the pressure sensors 41*a*, 41*c*, and 41*e* indicating lever operation amounts (operating pressures) are input to a demanded flow rate computing section 72, and the outputs from the pressure sensors 41*a*, 41*c*, and 41*e* are input to a meter-in opening computing section 74. It is noted that " . . . " suggesting elements that are not depicted in FIG. 1 are often omitted for convenience of simplification in FIGS. 5 to 15 and the following description.

Demanded flow rates Qr1, Qr2, and Qr3 that are outputs from the demanded flow rate computing section 72 and a flow rate Qa' that is an output from the main pump actual flow rate computing section 71 are sent to a demanded flow rate correction section 73.

Outputs from the pressure sensors 40*a*, 40*b*, and 40*c* indicating load pressures of the actuators are sent to a maximum value selection section 75, a flow rate control valve opening computing section 76, and a highest load pressure actuator determination section 77, and an output Ps from the pressure sensor 42 indicating a delivery pressure (pump pressure) of the main pump 2 is sent to a difference calculation section 82.

The flow rate control valve opening computing section 76 outputs command pressures (command values) Pi_a1, Pi_a2, and Pi_a3 to target opening areas A1, A2, and A3 to the solenoid proportional pressure reducing valves 20*a*, 20*b*, and 20*c*, respectively.

A highest load pressure Pl max that is an output from the maximum value selection section 75 is sent, together with the outputs Pl1, Pl2, and Pl3 from the pressure sensors 40*a*, 40*b*, and 40*c* described above, to the highest load pressure actuator determination section 77, and the determination section 77 sends an identifier i indicating the highest load pressure actuator to a highest load pressure actuator directional control valve meter-in opening computing section 78 and a highest load pressure actuator corrected demanded flow rate computing section 79. In addition, the highest load pressure Pl max is sent to an addition section 81.

The identifier i and meter-in opening areas Am1, Am2, and Am3 that are outputs from the meter-in opening computing section 74 are input to the highest load pressure actuator directional control valve meter-in opening computing section 78, and the highest load pressure actuator directional control valve meter-in opening computing section 78 outputs a meter-in opening area Ami of the directional control valve associated with the highest load pressure actuator.

The identifier i and demanded flow rates Qr1', Qr2', and Qr3' that are outputs from the demanded flow rate correction section 73 are input to the highest load pressure actuator corrected demanded flow rate computing section 79, and the highest load pressure actuator corrected demanded flow rate computing section 79 outputs a corrected demanded flow rate Qri' associated with the highest load pressure actuator.

The meter-in opening area Ami of the directional control valve associated with the highest load pressure actuator and the corrected demanded flow rate Qri' associated with the highest load pressure actuator are sent to a target differential pressure computing section 80, and the target differential pressure computing section 80 outputs a target differential pressure ΔPsd to the addition section 81, and outputs a command pressure (command value) Pi_ul to the solenoid proportional pressure reducing valve 22.

The addition section 81 outputs a target pump pressure Psd obtained by adding up the target differential pressure ΔPsd and the highest load pressure Pl max to the difference calculation section 82.

The difference calculation section 82 outputs a differential pressure ΔP obtained by subtracting the pump pressure (actual pump pressure) Ps that is the output from the pressure sensor 42 from the target pump pressure Psd to a main pump target tilting angle computing section 83, and the main pump target tilting angle computing section 83 outputs a command pressure (command value) Pi_fc to the solenoid proportional pressure reducing valve 21.

In the demanded flow rate computing section 72, the demanded flow rate correction section 73, the maximum value selection section 75, and the flow rate control valve opening computing section 76, the controller 70 is configured to compute demanded flow rates of the plurality of actuators 3*a*, 3*b*, and 3*c* on the basis of input amounts of operation levers of the plurality of operation lever devices 60*a*, 60*b*, and 60*c*, compute differential pressures between the highest load pressure among load pressures of the plurality of actuators 3*a*, 3*b*, and 3*c* detected by the pressure sensors 40*a*, 40*b*, and 40*c* (a plurality of first pressure sensors) and the load pressures of the plurality of actuators 3*a*, 3*b*, and 3*c* and compute target opening areas A1, A2, and A3 of the plurality of flow control valves 7*a*, 7*b*, and 7*c* on the basis of demanded flow rates of the plurality of actuators 3*a*, 3*b*, and 3*c* and the corresponding differential pressures and control opening areas of the plurality of flow control valves 7*a*, 7*b*, and 7*c* in such a manner that the opening areas of the plurality of flow control valves 7*a*, 7*b*, and 7*c* are equal to the target opening areas A1, A2, and A3.

Furthermore, in the demanded flow rate computing section 72, the demanded flow rate correction section 73, the meter-in opening computing section 74, the maximum value selection section 75, the highest load pressure actuator determination section 77, the directional control valve meter-in opening computing section 78, the corrected demanded flow rate computing section 79, and the target differential pressure computing section 80, the controller 70 is configured to compute meter-in opening areas of the plurality of directional control valves 6*a*, 6*b*, and 6*c* on the basis of the input amounts of the plurality of operation lever devices 60*a*, 60*b*, and 60*c*, compute a meter-in pressure loss of the specific directional control valve out of the plurality of directional control valves 6*a*, 6*b*, and 6*c* on the basis of the meter-in opening areas and the demanded flow rates of the plurality of actuators 3*a*, 3*b*, and 3*c*, and output this pressure loss as the target differential pressure ΔPsd to control a set pressure of the unloading valve 15.

Moreover, in the maximum value selection section 75, the highest load pressure actuator determination section 77, the corrected demanded flow rate computing section 79, and the target differential pressure computing section 80, the controller 70 is configured to compute, as the meter-in pressure loss of the specific directional control valve, a meter-in pressure loss of the directional control valve associated with the actuator having highest load pressure out of the plurality of directional control valves 6*a*, 6*b*, and 6*c* and output the pressure loss as the target differential pressure ΔPsd to control the set pressure of the unloading valve 15.

Furthermore, in the main pump target tilting angle computing section 83, the controller 70 is configured t compute the command value Pi_fc for making the delivery pressure of the main pump 2 detected by the pressure sensor 42 (second pressure sensor) equal to a pressure determined by adding the target differential pressure to the highest load pressure, and output the command value Pi_fc to the regulator (pump regulating device) to control the delivery flow rate from the main pump 2.

Figure 6:
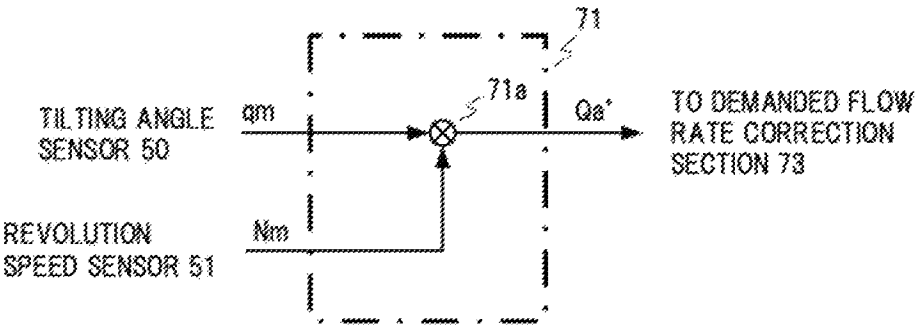
FIG. 6 is a functional block diagram of a main pump actual flow rate computing section in the controller.

FIG. 6 depicts a functional block diagram of the main pump actual flow rate computing section 71.

In the main pump actual flow rate computing section 71, a multiplier section 71*a* multiplies a tilting angle qm input from the tilting angle sensor 50 by a revolution speed Nm input from the revolution speed sensor 51, and calculates the flow rate Qa' of the hydraulic fluid actually delivered from the main pump 2.

Figure 7:
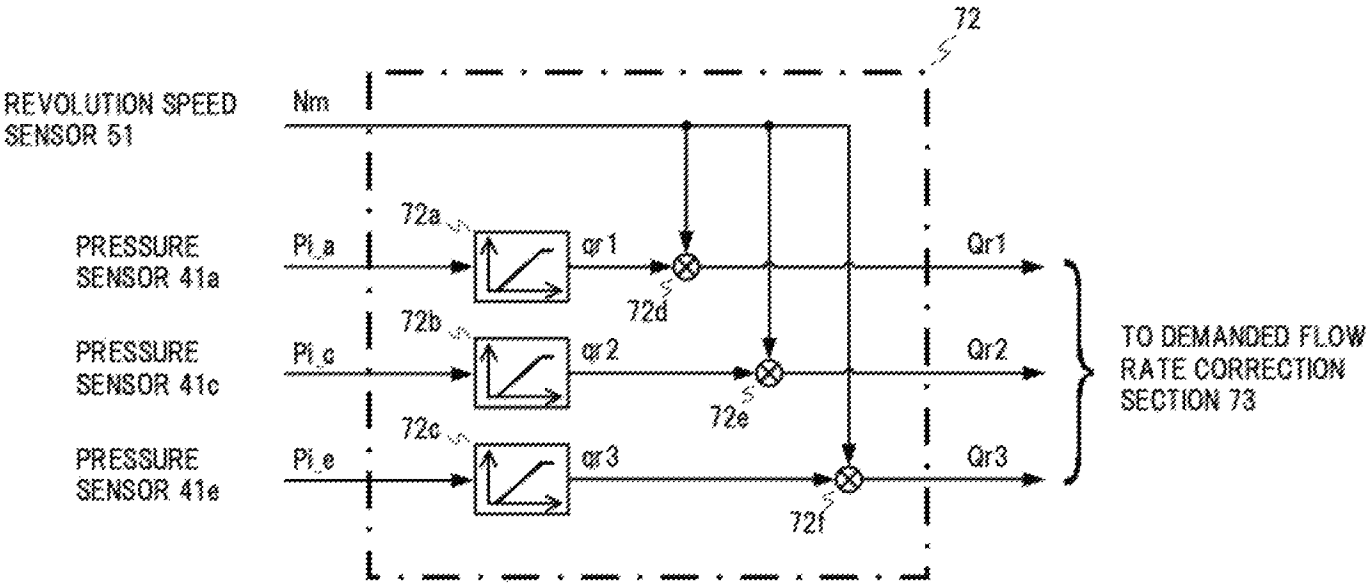
FIG. 7 is a functional block diagram of a demanded flow rate computing section in the controller.

FIG. 7 depicts a functional block diagram of the demanded flow rate computing section 72.

In the demanded flow rate computing section 72, tables 72*a*, 72*b*, and 72*c* convert the operating pressures Pi_a, Pi_c, and Pi_e input from the pressure sensors 41*a*, 41*c*, and 41*e* into reference demanded flow rates qr1, qr2, and qr3, multiplier sections 72*d*, 72*e*, and 72*f* multiply the reference demanded flow rates qr1, qr2, and qr3 by the revolution speed Nm input from the revolution speed sensor 51, and the demanded flow rates Qr1, Qr2, and Qr3 of the plurality of actuators 3*a*, 3*b*, and 3*c* are calculated.

Figure 8:
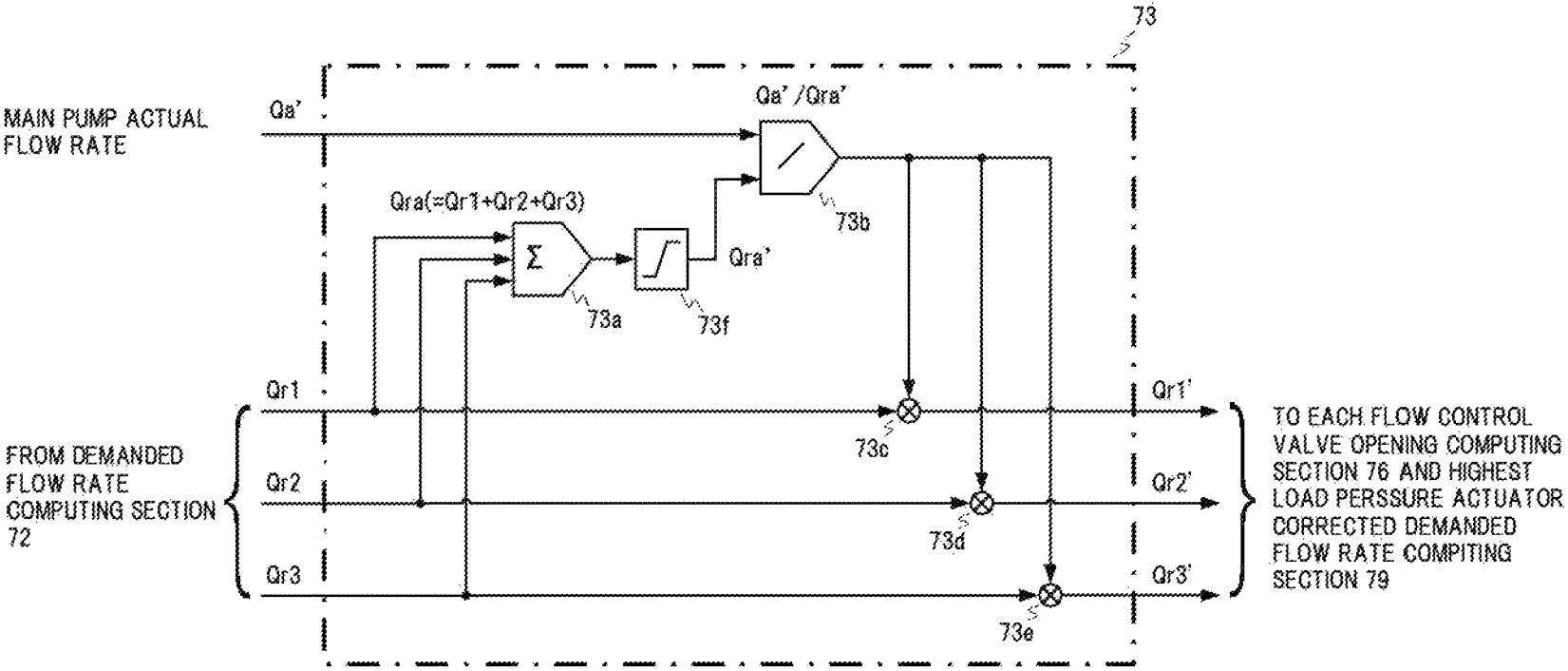
FIG. 8 is a functional block diagram of a demanded flow rate correction section in the controller.

FIG. 8 depicts a functional block diagram of the demanded flow rate correction section 73.

In the demanded flow rate correction section 73, the demanded flow rates Qr1, Qr2, and Qr3 that are outputs from the demanded flow rate computing section 72 are input to multiplier sections 73*c*, 73*d*, and 73*e* and a summing section 73*a*, the summing section 73*a* calculates a total value Qra, and the total value Qra is input to a denominator side of a divider section 73*b* through a limiting section 73*f* that limits a minimum value and a maximum value. On the other hand, the flow rate Qa' that is an output from the main pump actual flow rate computing section 71 is input to a numerator side of the divider section 73*b*, and the divider section 73*b* outputs a value of Qa'/Qra to the multiplier sections 73*c*, 73*d*, and 73*e*. The multiplier sections 73*c*, 73*d*, and 73*e* multiply Qr1, Qr2, and Qr3 described above each by Qa'/Qra and calculate the corrected demanded flow rates Qr1', Qr2', and Qr3', respectively.

Figure 9:
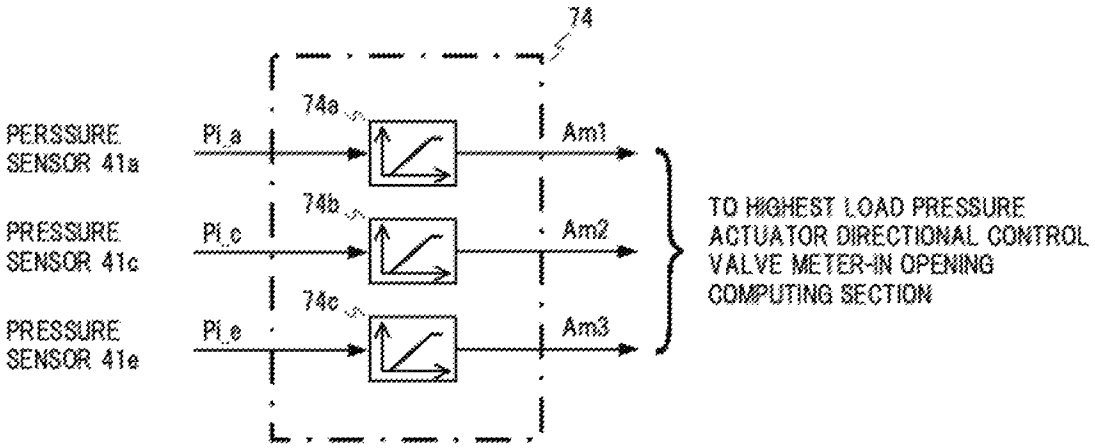
FIG. 9 is a functional block diagram of a meter-in opening computing section in the controller.

FIG. 9 depicts a functional block diagram of the meter-in opening computing section 74.

In the meter-in opening computing section 74, tables 74*a*, 74*b*, and 74*c* convert the operating pressures Pi_a, Pi_c, and Pi_e input from the pressure sensors 41*a*, 41*c*, and 41*e* into the meter-in opening areas Am1, Am2, and Am3 of the directional control valves. The tables 74*a*, 74*b*, and 74*c* store the meter-in opening area of the directional control valves 6*a*, 6*b*, and 6*c* in advance, and are each set to output 0 when the operating pressure is 0 and to output a larger value as the operating pressure is higher. Furthermore, a maximum value of the meter-in opening areas is set to an extremely large value so that a meter-in pressure loss (LS differential pressure) that is a pressure loss possibly generated in each of the meter-in openings of the directional control valves 6*a*, 6*b*, and 6*c* is extremely small.

Figure 10:
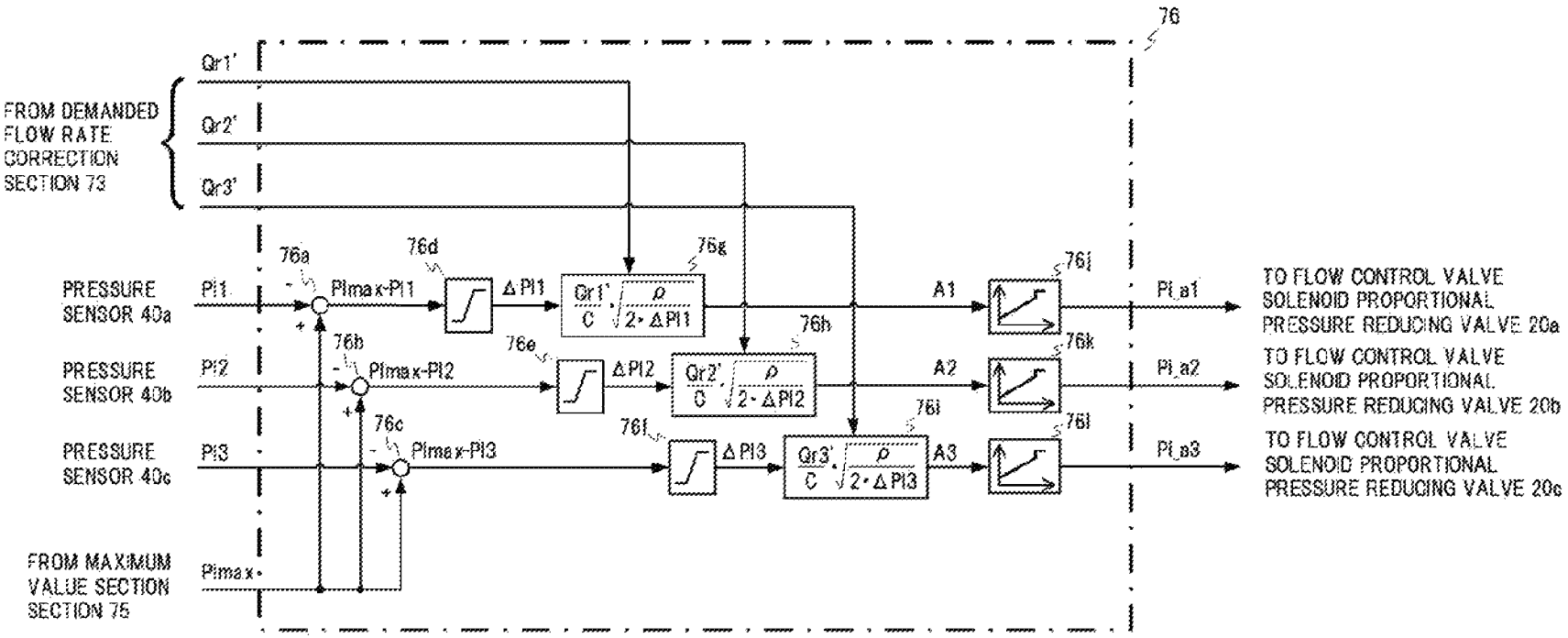
FIG. 10 is a functional block diagram of a flow rate control valve opening computing section in the controller.

FIG. 10 depicts a functional block diagram of the flow rate control valve opening computing section 76.

In the flow rate control valve opening computing section 76, the load pressures Pl1, Pl2, and Pl3 input from the pressure sensors 40*a*, 40*b*, and 40*c* are sent to negative sides of difference calculation sections 76*a*, 76*b*, and 76*c*, and the highest load pressure Pl max from the maximum value selection section 75 is sent to positive sides of the difference calculation sections 76*a*, 76*b*, and 76*c*. Computed differential pressures Pl max−Pl1, Pl max−Pl2, and Pl max−Pl3 are sent to limiting sections 76*d*, 76*e*, and 76*f*, the limiting sections 76*d*, 76*e*, and 76*f* limit minimum values and maximum values, and the differential pressures are sent, as ΔPl1, ΔPl2, and ΔPl3, to computing sections 76*g*, 76*h*, and 76*i*, respectively. The corrected demanded flow rates Qr1', Qr2', and Qr3' are also sent to the computing sections 76*g*, 76*h*, and 76*i* from the demanded flow rate correction section 73.

The computing sections 76*g*, 76*h*, and 76*i* compute the flow control valve opening areas A1, A2, and A3 (target opening areas of the flow control valves 7*a*, 7*b*, and 7*c*) by the following Equations, and output the flow control valve opening areas A1, A2, and A3 to tables 76*j*, 76*k*, and 76*l*, respectively. In Math. 1, C denote a preset contraction coefficient and ρ denotes a density of a hydraulic operating fluid.

[Math. 1]

$$A1 = \frac{Qr1'}{C} \cdot \sqrt{\frac{\rho}{2 \cdot \Delta Pl1}}$$

$$A2 = \frac{Qr2'}{C} \cdot \sqrt{\frac{\rho}{2 \cdot \Delta Pl2}}$$

$$A3 = \frac{Qr3'}{C} \cdot \sqrt{\frac{\rho}{2 \cdot \Delta Pl3}}$$

The tables 76*j*, 76*k*, and 76*l* convert the flow control valve opening areas A1, A2, and A3 into the command pressures (command values) Pi_a1, Pi_a2, and Pi_a3 to the solenoid proportional pressure reducing valves 20*a*, 20*b*, and 20*c*, and output the command pressures (command values) Pi_a1, Pi_a2, and Pi_a3.

Figure 11:
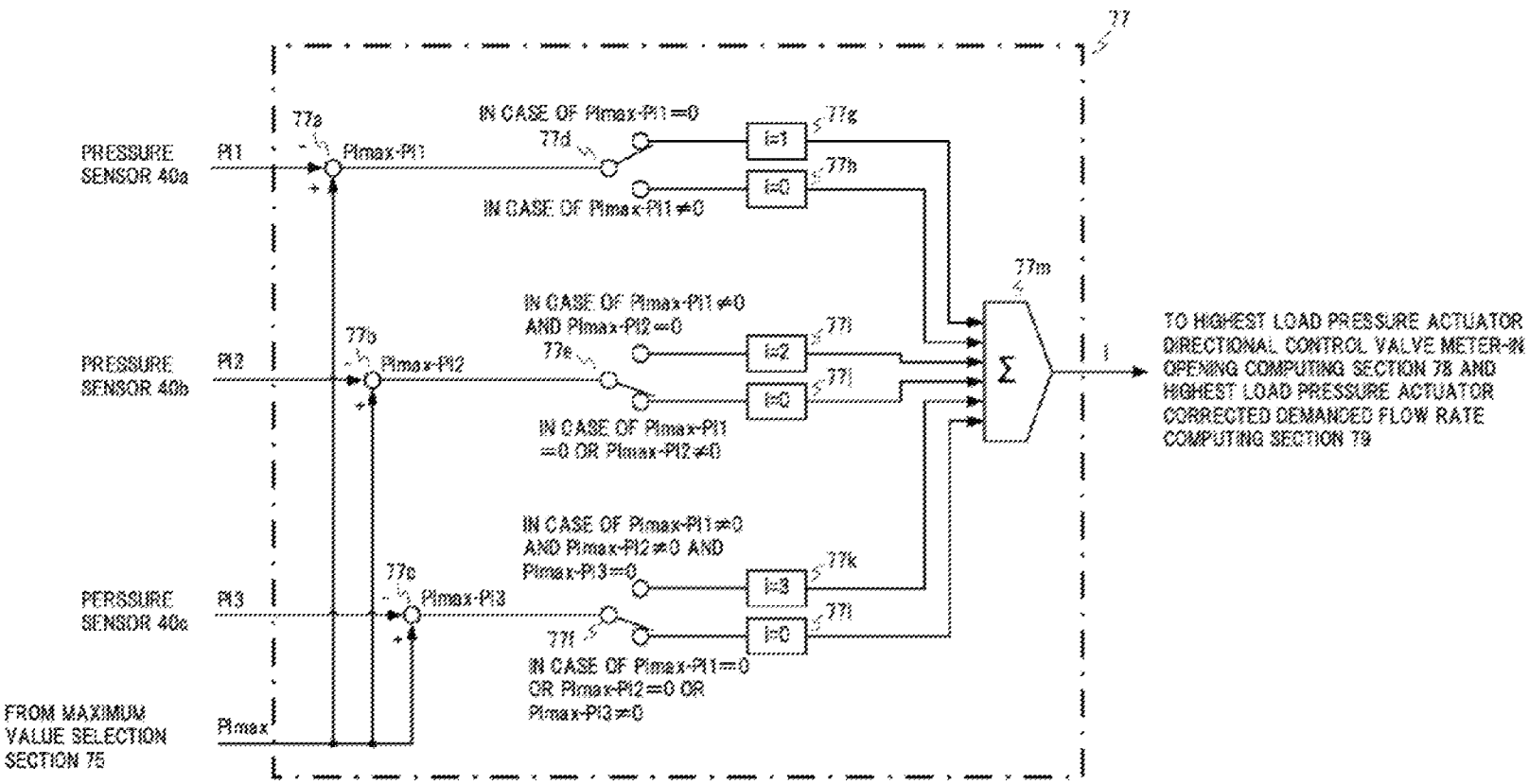
FIG. 11 is a functional block diagram of a highest load pressure actuator determination section in the controller.

FIG. 11 depicts a functional block diagram of the highest load pressure actuator determination section 77.

In the highest load pressure actuator determination section 77, the load pressures Pl1, Pl2, and Pl3 input from the pressure sensors 40*a*, 40*b*, and 40*c* are sent to negative sides of difference calculation sections 77*a*, 77*b*, and 77*c*, the highest load pressure Pl max from the maximum value selection section 75 is sent to positive sides of the difference calculation sections 77*a*, 77*b*, and 77*c*, and the difference calculation sections 77*a*, 77*b*, and 77*c* output Pl max−Pl1, Pl max−Pl2, and Pl max−Pl3 to the determination sections 77*d*, 77*e*, and 77*f*, respectively. In each of the determination sections 77*d*, 77*e*, and 77*f*, the determination section is in an On-state and changed over to an upper side in FIG. 11 in a case in which a determination sentence is true, and in an Off-state and changed over to a lower side in FIG. 11 in a case in which the determination sentence is false.

Since FIG. 11 depicts a case of Pl max=Pl1, that is, Pl max−Pl1=0, a computing section 77*g* is selected and i=1 is output to a summing section 77*m* as the identifier i. On the other hand, since FIG. 11 depicts a case in which the determination sentence is false in the determination sections 77*e* and 77*f*, computing sections 77*j* and 771 are selected and i=0 is output to the summing section 77*m* as the identifier i. The summing section 77*m* sums up outputs from the computing sections 77*g*, 77*j*, and 771 and outputs i=1.

In this way, the summing section 77*m* outputs i=1 in the case of Pl max=Pl1. Likewise, the summing section 77*m* outputs i=2 in a case of Pl max=Pl2 and outputs i=3 in a case of Pl max=Pl3.

Figure 12:
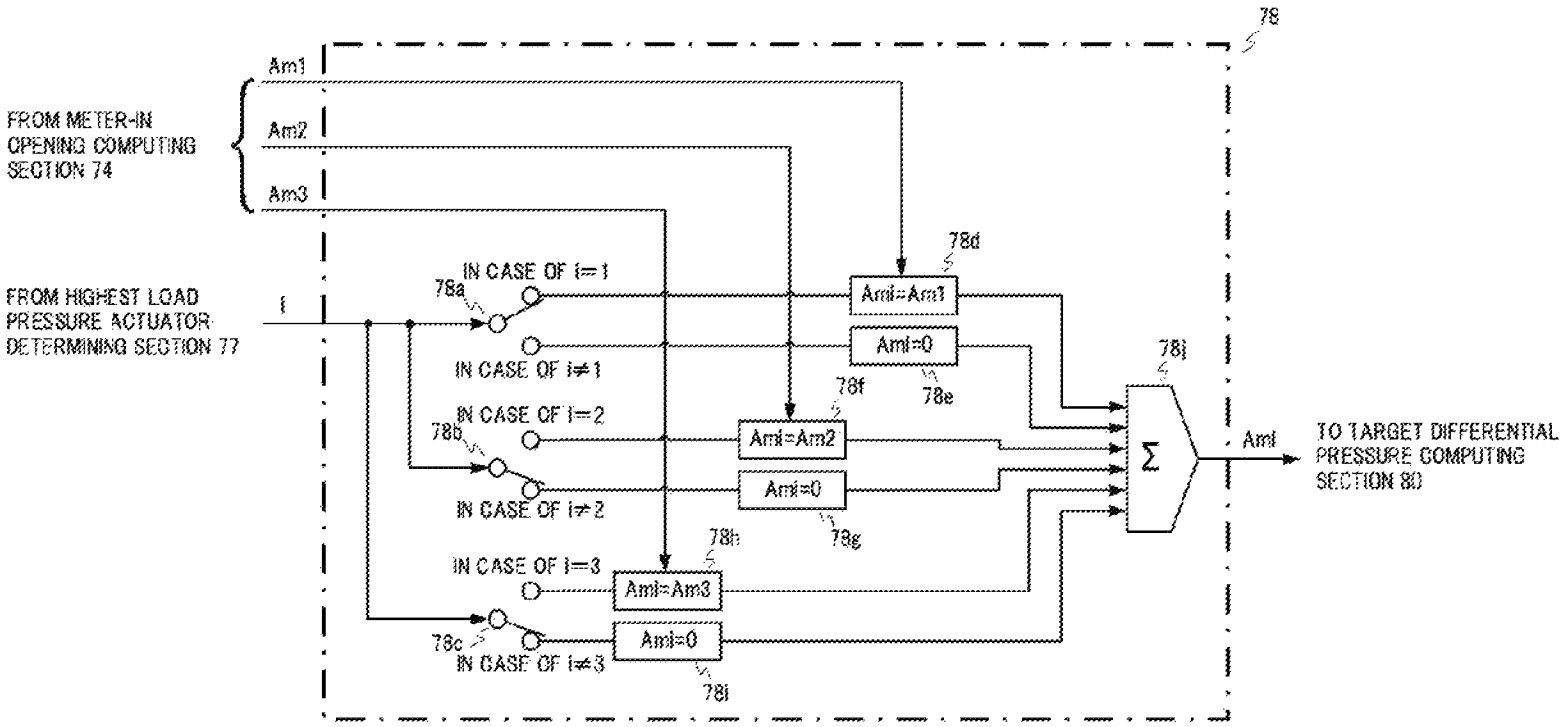
FIG. 12 is a functional block diagram of a highest load pressure actuator directional control valve meter-in opening computing section in the controller.

FIG. 12 depicts a functional block diagram of the highest load pressure actuator directional control valve meter-in opening computing section 78.

In the highest load pressure actuator directional control valve meter-in opening computing section 78, the identifier i input from the highest load pressure actuator determination section 77 is sent to determination sections 78*a*, 78*b*, and 78*c*, and the meter-in opening areas Am1, Am2, and Am3 input from the meter-in opening computing section 74 are sent to computing sections 78*d*, 78*f*, and 78*h*, respectively. FIG. 12 depicts a case of i=1.

Because of i=1, the determination section 78*a* is in an On-state and changed over to an upper side in FIG. 12, the computing section 78*d* is selected, and the computing section 78*d* sends Am1 to a summing section 78*j* as the meter-in opening area Ami. Furthermore, the determination sections 78*b* and 78*c* are each in an Off-state and changed over to a lower side in FIG. 12, computing sections 78*g* and 78*i* are selected, and the computing sections 78*g* and 78*i* each send 0 to the summing section 78*j* as the meter-in opening area Ami. The summing section 78*j* outputs Am1+0+0=Am1 as the meter-in opening area Ami.

Likewise, in a case of i=2, the summing section 78*j* outputs Am2 as the meter-in opening area Ami, and in a case of i=3, the summing section 78*j* outputs Am3 as the meter-in opening area Ami.

Figure 13:
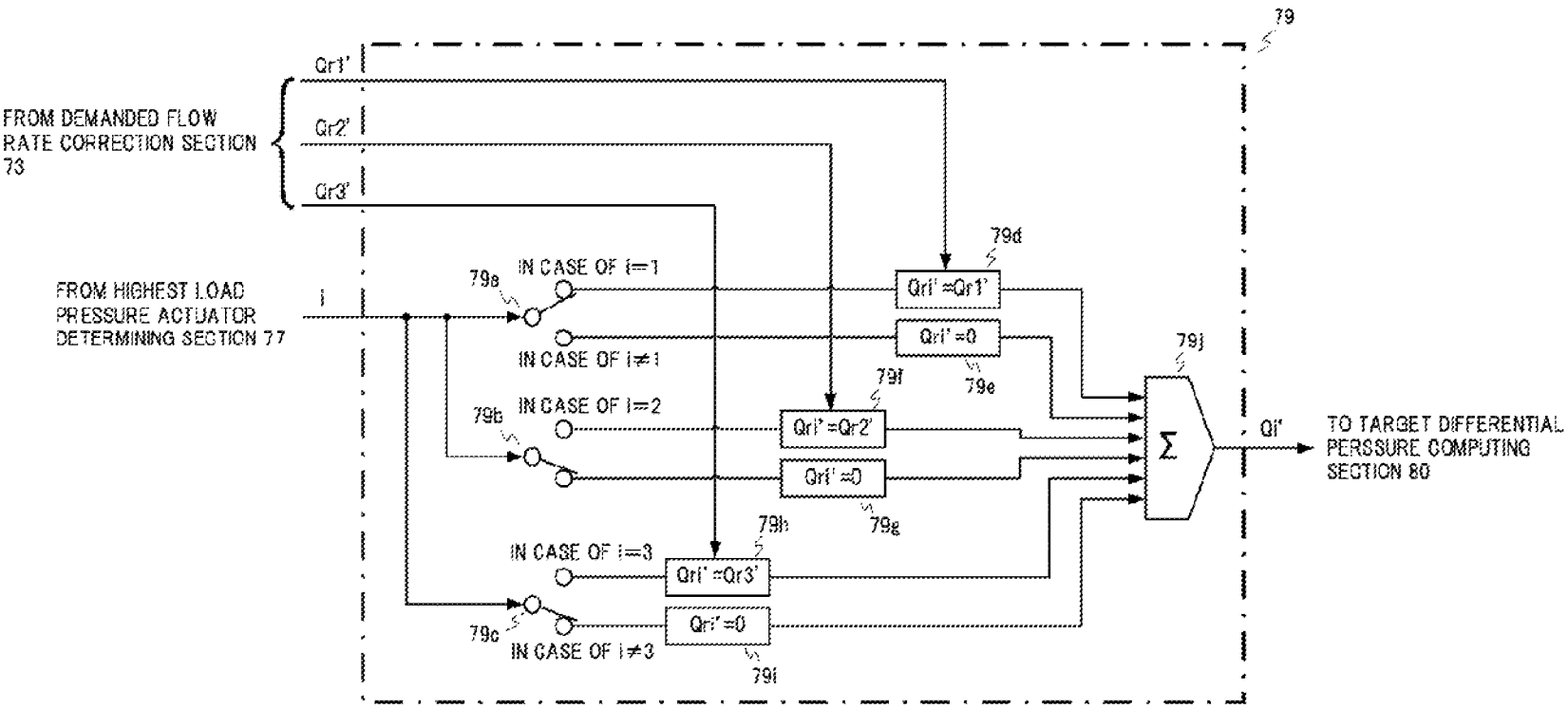
FIG. 13 is a functional block diagram of a highest load pressure actuator corrected demanded flow rate computing section in the controller.

FIG. 13 depicts a functional block diagram of the highest load pressure actuator corrected demanded flow rate computing section 79.

In the highest load pressure actuator corrected demanded flow rate computing section 79, the identifier i input from the highest load pressure actuator determination section 77 is sent to determination sections 79*a*, 79*b*, and 79*c*, and the corrected demanded flow rates Qr1', Qr2', and Qr3' input from the demanded flow rate correction section 73 are sent to computing sections 79*d*, 79*g*, and 79*h*, respectively. FIG. 13 depicts the case of i=1.

Because of i=1, the determination section 79*a* is in an On-state and changed over to an upper side in FIG. 13, a computing section 79*d* is selected, and the computing section 79*d* sends Qr1' to a summing section 79*j* as the corrected demanded flow rate Qri'. Furthermore, the determination sections 79*b* and 79*c* are each in an Off-state and changed over to a lower side in FIG. 13, computing sections 79*g* and 79*i* are selected, and the computing sections 79*g* and 79*i* each send 0 to the summing section 79*j* as the corrected demanded flow rate Qri'. The summing section 79*j* outputs Qr1'+0+0 as the corrected demanded flow rate Qri'.

Likewise, in the case of i=2, the summing section 79*j* outputs Qr2' as the corrected demanded flow rate Qri', and in the case of i=3, the summing section 79*j* outputs Qr3' as the corrected demanded flow rate Qri'.

Figure 14:
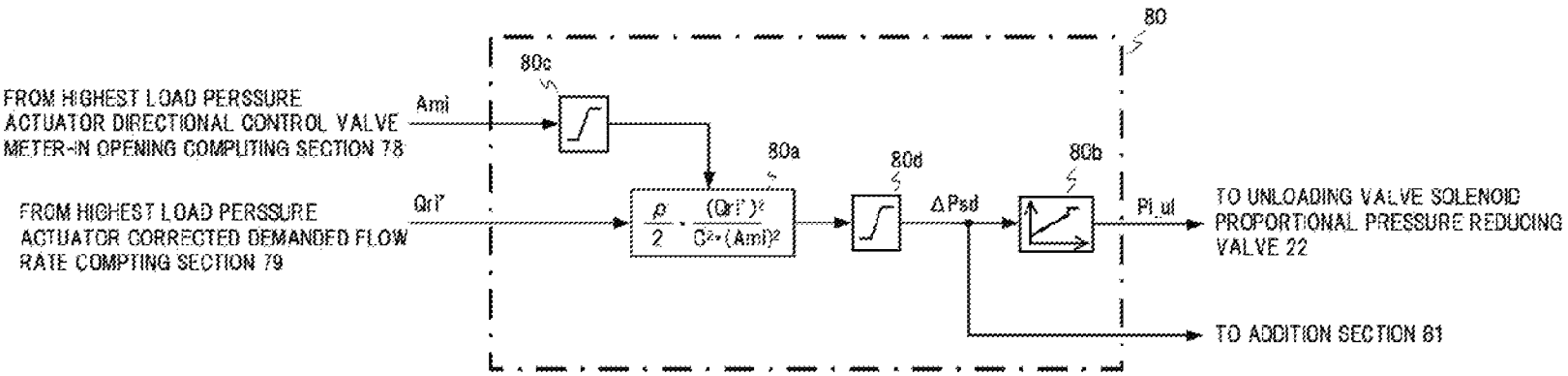
FIG. 14 is a functional block diagram of a target differential pressure computing section in the controller.

FIG. 14 depicts a functional block diagram of the target differential pressure computing section 80.

In the target differential pressure computing section 80, the corrected demanded flow rate Qri' input from the highest load pressure actuator corrected demanded flow rate computing section 79 is sent to a computing section 80*a*, the meter-in opening area Ami input from the highest load pressure actuator directional control valve meter-in opening computing section 78 is sent to the computing section 80*a* through a limiting section 80*c* that limits a minimum value and a maximum value, and the computing section 80*a* computes the meter-in pressure loss ΔPsd of the directional control valve associated with the highest load pressure actuator is computed by the following Equation. In Math. 2, C denotes the preset contraction coefficient and p denotes the density of the hydraulic operating fluid.

$$\Delta Psd = \frac{\rho}{2} \cdot \frac{(Qri')^2}{C^2 \cdot (Ami)^2} \quad \text{[Math. 2]}$$

This pressure loss ΔPsd is passed through a limiting section 80*d* that limits a minimum value and a maximum value, and output to a table 80*b* and the external addition section 81 as the target differential pressure ΔPsd (regulating pressure for variably controlling the set pressure of the unloading valve 15). The table 80*b* converts the target differential pressure ΔPsd into the command pressure (command value) Pi_ul to the solenoid proportional pressure reducing valve 22, and outputs the command value Pi_ul to the solenoid proportional pressure reducing valve 22.

Figure 15:
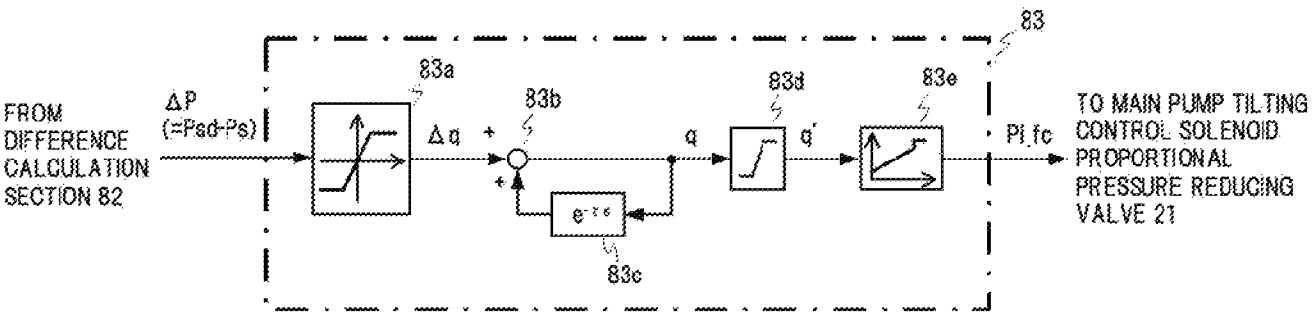
FIG. 15 is a functional block diagram of a main pump target tilting angle computing section in the controller.

FIG. 15 depicts a functional block diagram of the main pump target tilting angle computing section 83.

In the main pump target tilting angle computing section 83, the differential pressure ΔP (=Psd−Ps) computed by the difference calculation section 82 is input to a table 83*a*, and the table 83*a* converts the differential pressure ΔP into a target capacity increment or decrement Δq. An addition section 83*b* adds the increment or decrement Δq a target capacity q' one control cycle before output from a delay element 83*c* and outputs an addition result to a limiting section 83*d* as a new target capacity q, the limiting section 83*d* limits the new target capacity q to a value between a minimum value and a maximum value, and a resultant target capacity is introduced, as a limited target capacity q', to a table 83*e*. The table 83*e* converts the target capacity q' into the command pressure (command value) Pi_fc to the solenoid proportional pressure reducing valve 21, and outputs the command value Pi_fc to the solenoid proportional pressure reducing valve 21.

~Actuations~

Actuations of the hydraulic drive system configured as described above will be described.

The hydraulic fluid delivered from the fixed displacement pilot pump 30 is supplied to the hydraulic fluid supply line 31*a* and the constant pilot primary pressure Pi0 is generated by the pilot relief valve 32 in the hydraulic fluid supply line 31*a*.

(a) In a Case in which all Operation Levers are Neutral

Since the operation levers of all the operation lever devices 60*a*, 60*b*, and 60*c* are neutral, all the pilot valves are neutral and the operating pressures a, b, c, d, e, and f are equal to the tank pressure; thus, all the directional control valves 6*a*, 6*b*, and 6*c* are at neutral positions.

The boom raising operating pressure a, the arm crowding operating pressure c, and the swing operating pressure e are detected by the pressure sensors 41*a*, 41*c*, and 41*e*, and the operating pressures Pi_a, Pi_c, and Pi_e are sent to the demanded flow rate computing section 72 and the meter-in opening computing section 74.

The tables 72*a*, 72*b*, and 72*c* in the demanded flow rate computing section 72 store reference demanded flow rates in response to lever inputs for boom raising, arm crowding, and a swing operation, and are each set to output 0 when an input is 0 and to output a larger value as the input is larger.

As described above, in the case in which all the operation levers are neutral, the operating pressures Pi_a, Pi_c, and Pi_e are all equal to the tank pressure. Therefore, the reference demanded flow rates qr1, qr2, and qr3 computed by the tables 72*a*, 72*b*, and 72*c* are all equal to 0. Since the reference demanded flow rates qr1, qr2, and qr3 computed by the tables 72*a*, 72*b*, and 72*c* are all equal to 0, the demanded flow rates Qr1, Qr2, and Qr3 that are outputs from the multiplier sections 72*d*, 72*e*, and 72*f* are all equal to 0.

Furthermore, the tables 74*a*, 74*b*, and 74*c* in the meter-in opening computing section 74 store meter-in openings of the directional control valves 6*a*, 6*b*, and 6*c* in advance, and are each set to output 0 when an input is 0 and to output a larger value as the input is larger.

As described above, in the case in which all the operation levers are neutral, the operating pressures Pi_a, Pi_c, and Pi_e are all equal to the tank pressure. Therefore, the meter-in opening areas Am1, Am2, and Am3 that are outputs from the tables 74*a*, 74*b*, and 74*c* are all equal to 0.

The demanded flow rates Qr1, Qr2, and Qr3 are input to the demanded flow rate correction section 73.

The demanded flow rates Qr1, Qr2, and Qr3 input to the demanded flow rate correction section 73 are sent to the summing section 73*a* and the multiplier sections 73*c*, 73*d*, and 73*e*.

While the summing section 73*a* computes Qra=Qr1+Qr2+Qr3, Qra=0+0+0 in the case in which all the operation levers are neutral as described above.

The limiting section 73*f* limits the total value Qra to a value between the minimum value and the maximum value at which the hydraulic fluid can be delivered from the main pump 2. In a case of assuming herein that the minimum value is Qmin and the maximum value is Qmax and all the operation levers are neutral, Qra=0<Qmin; thus, the limiting section 73*f* limits the total value to Qmin and Qra'=Qmin is sent to the denominator side of the divider section 73*b*.

On the other hand, in the case in which all the operation levers are neutral, a main pump actual flow rate is kept to the minimum value Qmin as described later; thus, the divider section 73*b* outputs Qr'/Qra'=1 to the multiplier sections 73*c*, 73*d*, and 73*e*.

As described above, in the case in which all the operation levers are neutral, Qr1, Qr2, and Qr3 are all equal to 0; thus, the corrected demanded flow rates Qr1', Qr2', and Qr3' that are the outputs from the multiplier sections 73*c*, 73*d*, and 73*e* are all equal to 0×1=0.

On the other hand, in the case in which all the operation levers are neutral, then the load pressures Pl1, Pl2, and Pl3 of the actuators that are sent to the flow rate control valve opening computing section 76 and that are the outputs from the pressure sensors 40*a*, 40*b*, and 40*c* are all equal to the tank pressure and the output Pl max from the maximum value selection section 75 is also equal to the tank pressure.

To prevent division by 0 in the computing sections 76*g*, 76*h*, and 76*i* receiving the outputs from the limiting sections 76*d*, 76*e*, and 76*f*, minimum values ΔPl1 min, ΔPl2 min, and ΔPl3 min greater than 0 are set in advance to the limiting sections 76*d*, 76*e*, and 76*f*. While Pl max−Pl1=Pl max−Pl2=Pl max−Pl3=0 in the case in which all the operation levers are neutral, the outputs from the limiting sections 76*d*, 76*e*, and 76*f* are kept to the minimum values ΔPl1 min, ΔPl2 min, and ΔPl3 min, respectively.

On the other hand, the corrected demanded flow rates Qr1', Qr2', and Qr3' input from the demanded flow rate correction section 73 are all equal to 0.

The computing sections 76*g*, 76*h* and 76*i* output 0 as the opening areas A1, A2, and A3 since the numerators Qr1', Qr2', and Qr3' are equal to 0 and the denominators ΔPl1, ΔPl2, and ΔPl3 are the minimum values ΔPl1 min, and ΔPl2 min, and ΔPl3 min greater than 0 as described above.

The tables 76*j*, 76*k*, and 76*l* convert the opening areas A1, A2, and A3 into the command pressures Pi_a1, Pi_a2, and Pi_a3 to the solenoid proportional pressure reducing valves 20*a*, 20*b*, and 20*c*, respectively. As described above, in the case in which the opening areas A1, A2, and A3 are equal to 0, the command pressures Pi_a1, Pi_a2, and Pi_a3 are also kept to minimum pressures.

Since the command pressures Pi_a1, Pi_a2, and Pi_a3 are kept to the minimum pressures, the flow control valves 7*a*, 7*b*, and 7*c* are kept to be fully closed.

On the other hand, while the maximum value selection section 75 outputs the maximum value of the load pressures Pl1, Pl2, and Pl3 as Pl max, the maximum value Pl max is also kept to the tank pressure 0 in the case in which all the operation levers are neutral, as described above.

In the highest load pressure actuator determination section 77, the difference calculation sections 77*a*, 77*b*, and 77*c* calculate Pl max−Pl1, Pl max−Pl2, and Pl max−Pl3, and output Pl max−Pl1, Pl max−Pl2, and Pl max−Pl3 to the determination sections 77*d*, 77*e*, and 77*f*, respectively.

As described above, in the case in which Pl1, Pl2, Pl3, and Pl max are all kept to the tank pressure, Pl max−Pl1, Pl max−Pl2, and Pl max−Pl3 are all equal to 0. Since the Pl max−Pl1=0 established in the determination section 77*d*, i=1 is output to the summing section 77*m*. Because of Pl max−Pl1=0, the determination section 77*e* outputs i=0 to the summing section 77*m* as the identifier i. Likewise, because of Pl max−Pl1=0, the determination section 77*f* outputs i=0 to the summing section 77*m*.

The summing section 77*m* outputs 1+0+0, that is, 1 as the identifier i.

The output i from the highest load pressure actuator determination section 77 is sent to the highest load pressure actuator directional control valve meter-in opening computing section 78 and the highest load pressure actuator corrected demanded flow rate computing section 79.

The identifier i sent to the highest load pressure actuator directional control valve meter-in opening computing section 78 is 1 in the case in which all the operation levers are neutral as described above. Thus, i=1 is established in the determination section 78*a*, and the value of Am1 is selected as the meter-in opening area Ami and sent to the summing section 78*j*. In the case of i=1, the determination sections 78*b* and 78*c* both send 0 to the summing section 78*j* as the meter-in opening area Ami. The summing section 78*j* outputs Am1+0+0, that is, Am1 as the meter-in opening area Ami.

On the other hand, since the identifier i sent to the highest load pressure actuator corrected demanded flow rate computing section 79 is equal to 1, i=1 is established in the determination section 79*a*, and Qr1' is selected as Qri' and sent to the summing section 79*j*. In the case of i=1, the determination sections 79*b* and 79*c* both send 0 to the summing section as Qri'. The summing section 79*j* outputs Qr1'+0+0, that is, Qr1' as Qri'.

In the target differential pressure computing section 80, Am1 and Qr1' are sent to the computing section 80*a* and Am1 is limited to a minimum value Am1' greater than 0 and set by the limiting section 80*c* in advance.

In the case in which all the operation levers are neutral, both Am1 and Qr1' are equal to 0; however, Am1 is limited to the certain value greater than 0, and ΔPsd that is the output from the computing section 80*a* is, therefore, equal to 0. The output from the computing section 80*a* is limited to the value equal to or greater than 0 and equal to or smaller than a preset maximum value ΔPsd max of the target differential pressure by the limiting section 80*d*.

In the case in which all the operation levers are neutral, the target differential pressure ΔPsd is equal to 0.

The target differential pressure ΔPsd that is the output from the limiting section 80*d* is converted into the command pressure (command value) to the solenoid proportional pressure reducing valve 22 by the table 80*b*.

In the case in which all the operation levers are neutral as described above, the highest load pressure Pl max is equal to the tank pressure.

The set pressure of the unloading valve 15 is determined by the highest load pressure Pl max introduced to the pressure receiving section 15*a*, the spring 15*b*, and the pressure ΔPsd output from the solenoid proportional pressure reducing valve 22 and introduced to the pressure receiving section 15*c*. The set pressure of the unloading valve 15 is kept to quite a small value specified by the spring 15*b* since the highest load pressure Pl max and the output pressure ΔPsd from the solenoid proportional pressure reducing valve 22 are both equal to the tank pressure.

Owing to this, the hydraulic fluid delivered from the variable displacement main pump 2 is discharged from the unloading valve 15 to the tank, and the pressure in the hydraulic fluid supply line 5 is kept to the low pressure described above.

On the other hand, the target differential pressure ΔPsd that is the output from the target differential pressure computing section 80 is added to the highest load pressure Pl max by the addition section 81. However, as described above, in the case in which all the operation levers are neutral, Pl max and ΔPsd are equal to the tank pressure of 0; thus, the target pump pressure Psd that is the output from the addition section 81 is also equal to 0.

The target pump pressure Psd and the pump pressure Ps detected by the pressure sensor 42 are introduced to the positive and negative sides of the difference calculation section 82, respectively, and the difference between the target pump pressure Psd and the pump pressure Ps is input, as ΔP=Psd−Ps, to the main pump target tilting angle computing section 83.

In the main pump target tilting angle computing section 83, the table 83*a* converts ΔP (=Psd−Ps) described above into the target capacity increment or decrement Δq. As depicted in FIG. 15, the table 83*a* indicates Δq<0 at ΔP<0, Δq=0 at ΔP=0, and Δq>0 at ΔP>0; thus, in a case in which ΔP is large or small to some extent, the table 83*a* is configured to limit the value to a preset value.

The target capacity increment or decrement Δq is added to the target capacity q' one control step before to be described later by the addition section 83*b* to obtain q, and q is limited to the value between physical minimum and maximum values of the main pump 2 by the limiting section 83*d* and output as the target capacity q'.

The target capacity q' is converted into the command pressure Pi_fc to the solenoid proportional pressure reducing valve 21 by the table 83*e*, and the solenoid proportional pressure reducing valve 21 is controlled on the basis of the command pressure Pi_fc.

As described above, in the case in which all the operation levers are neutral, Psd (=highest load pressure Pl max+target differential pressure ΔPsd) is equal to the tank pressure.

On the other hand, the pressure in the hydraulic fluid supply line 5, that is, the pump pressure Ps is kept to a higher pressure than the tank pressure by the value specified by the spring 15*b* by the unloading valve 15 as described above.

Owing to this, in the case in which all the operation levers are neutral, ΔP (=Psd−Ps)<0 and Δq<0 is, therefore, set by the table 83*a*. The target capacity increment or decrement Δq is added to the target capacity q' one step before obtained in the delay element 83*c* by the addition section 83*b* to obtain the new target capacity q. Since the target capacity q is limited to the value between the minimum and maximum values of the main pump 2 by the limiting section 83*d*, the target capacity q' one step before is kept to the minimum value.

(b) In a Case of Performing a Boom Raising Operation

The boom raising operating pressure a is output from the pilot valve of the boom operation lever device 60*a*. The boom raising operating pressure a is introduced to the directional control valve 6*a* and the pressure sensor 41*a*, and the directional control valve 6*a* is changed over to a right direction in the drawing.

The boom raising operating pressure a is input, as the output Pi_a from the pressure sensor 41*a*, to the demanded flow rate computing section 72, and the demanded flow rate Qr1 is calculated.

While the main pump actual flow rate computing section 71 calculates the flow rate of the hydraulic fluid actually delivered from the main pump 2 in response to the inputs from the tilting angle sensor 50 and the revolution speed sensor 51, tilting of the main pump 2 is kept to minimum and the main pump actual flow rate Qa' is also a minimum value right after a boom raising operation is performed from the state in which all the operation levers are neutral, as described in (a) In a case in which all operation levers are neutral.

The demanded flow rate Qr1 is limited to the main pump actual flow rate Qa' by the demanded flow rate correction section 73 and corrected to Qr1'.

Furthermore, the boom raising operating pressure a is also introduced, as the output Pi_a from the pressure sensor 41*a*, to the meter-in opening computing section 74, and converted into the meter-in opening area Am1 by the table 74*a*, and the meter-in opening area Am1 is output.

On the other hand, the load pressure of the boom cylinder 3*a* is introduced to the pressure sensor 40*a* through the directional control valve 6*a* and introduced to the unloading valve 15 through the shuttle valve 9*a* as the highest load pressure Pl max.

The load pressure of the boom cylinder 3*a* is introduced, as the output Pl1 from the pressure sensor 40*a*, to the maximum value selection section 75, the flow rate control valve opening computing section 76, and the highest load pressure actuator determination section 77.

In a case of operating only the boom cylinder 3*a*, the maximum value selection section 75 selects Pl1 as the highest load pressure Pl max.

In the flow rate control valve opening computing section 76, the difference calculation section 76*a* computes Pl max−Pl1 that is the difference between the highest load pressure Pl max and the load pressure Pl1 of the boom cylinder 3*a*. In the case in which the boom raising operation is solely performed, Pl max=Pl1 and, therefore, Pl max−Pl1=0. The limiting section 76*d* keeps the difference Pl max−Pl1 to the minimum value as close to preset 0 as possible, and the difference is input to the computing section 76*g* as ΔPl1. Qr1' output from the demanded flow rate correction section 73 is also input to the computing section 76*g*. However, in the case of the sole boom raising operation, ΔPl1 is quite a small value as described above; thus, the output A1 from the computing section 76*g* calculated by the following Equation is equal to a large value closer to an infinity.

$$A1 = \frac{Qr1'}{C} \cdot \sqrt{\frac{\rho}{2 \cdot \Delta Pl1}} \quad \text{[Math. 3]}$$

A1 is converted into the command pressure Pi_a1 to the solenoid proportional pressure reducing valve 20*a* by the table 76*j*. Since A1 is the large value closer to the infinity as described above, Pi_a1 is kept to the maximum value and the flow control valve 7*a* controlled by the flow control valve solenoid proportional pressure reducing valve 20*a* is also kept to the maximum opening.

In this way, the hydraulic fluid delivered from the main pump 2 is supplied to a bottom side of the boom cylinder 3*a* through the hydraulic fluid supply line 5, the flow control valve 7*a*, the check valve 8*a*, and the directional control valve 6*a*, and the boom cylinder 3*a* is expanded.

Furthermore, the flow rate control valve opening computing section 76 similarly calculates the opening areas A2 and A3 of the flow control valves 7*b* and 7*c*. In the case of the sole boom raising operation, the load pressure Pl2 of the arm cylinder 3*b* and the load pressure Pl3 of the swing motor 3*c* are both equal to the tank pressure; thus, Pl max−Pl2 and Pl max−Pl3 calculated by the difference calculation sections 76*b* and 76*c* are both equal to Pl max, that is, equal to Pl1. On the other hand, the corrected demanded flow rates Qr2' and Qr3' input from the demanded flow rate correction section 73 are both 0; thus, A2 and A3 output from the computing sections 76*h* and 76*i* are both equal to 0. A2 and A3 are converted into the command pressures Pi_a2 and Pi_a3 to the solenoid proportional pressure reducing valves 20*b* and 20*c* by the tables 76*k* and 76*l*, respectively. Since A2 and A3 are both equal to 0 as described above, Pi_a2 and Pi_a3 are both equal to the tank pressure and the flow control valves 7*b* and 7*c* are both kept in fully closed states.

In the case of solely performing the boom raising operation, Pl max−Pl1=0 as described above. Therefore, in the highest load pressure actuator determination section 77, the determination section 77*d* sends i=1 to the summing section 77*m*. On the other hand, the determination sections 77*e* and 77*f* send i=0 to the summing section 77*m*.

The summing section 77*m* outputs 1, as the identifier i, to the highest load pressure actuator directional control valve meter-in opening computing section 78 and the highest load pressure actuator corrected demanded flow rate computing section 79.

In the highest load pressure actuator directional control valve meter-in opening computing section 78, the determination section 78*a* selects Am1 as the meter-in opening area Ami and outputs the Am1 to the summing section 78*j*. Furthermore, the determination sections 78*b* and 78*c* select 0 as the meter-in opening area Ami and output 0 to the summing section 78*j*. Eventually, Am1+0+0=Am1 is output as the meter-in opening area.

Moreover, in the highest load pressure actuator corrected demanded flow rate computing section 79, the determination section 79*a* selects Qr1' as Qri' and outputs Qr1' to the summing section 79*j*. Furthermore, the determination sections 79*b* and 79*c* both select 0 as Qri' and output 0 to the summing section 79*j*. Eventually, Qr1'+0+0=Qr1' is output as the corrected demanded flow rate.

The meter-in opening area Am1 output from the highest load pressure actuator directional control valve meter-in opening computing section 78 and the corrected demanded flow rate Qr1' output from the highest load pressure actuator corrected demanded flow rate computing section 79 are sent to the target differential pressure computing section 80.

In the target differential pressure computing section 80, Am1 and Qr1' are sent to the computing section 80*a*, and the computing section 80*a* perform computing illustrated in the following Equation and outputs the target differential pressure ΔPsd.

$$\Delta Psd = \frac{\rho}{2} \cdot \frac{(Qr1')^2}{C^2 \cdot (Am1)^2} \quad \text{[Math. 4]}$$

The target differential pressure ΔPsd output from the computing section 80*a* is limited to the value in a certain range by the limiting section 80*d* and converted into the command pressure Pi_ul to the solenoid proportional pressure reducing valve 22 by the table 80*b*.

The output ΔPsd from the solenoid proportional pressure reducing valve 22 is sent to the pressure receiving section 15*c* of the unloading valve 15 and functions to increase the set pressure of the unloading valve 15 by ΔPsd.

As described above, the load pressure Pl1 of the boom cylinder 3*a* is introduced as Pl max to the pressure receiving section 15*a* of the unloading valve 15. Owing to this, the set pressure of the unloading valve 15 is set to Pl max+ΔPsd+spring force, that is, Pl1 (load pressure of the boom cylinder 3*a*)+ΔPsd (differential pressure generated in the meter-in opening of the directional control valve 6*a* for controlling the boom cylinder 3*a*)+spring force, and the unloading valve 15 interrupts a hydraulic line through which hydraulic fluid from the hydraulic line 5 is discharged to the tank.

On the other hand, the target differential pressure ΔPsd limited to the certain range by the limiting section 80*d* is output to the addition section 81.

The addition section 81 adds up the highest load pressure Pl max and the difference ΔPsd to calculate the target pump pressure Psd=Pl max+ΔPsd. In the case of solely performing the boom raising operation, Pl max=Pl1 as described above; thus, the addition section 81 calculates the target pump pressure Psd=Pl1 (load pressure of the boom cylinder 3*a*)+ΔPsd (differential pressure generated in the meter-in opening of the directional control valve 6*a* for controlling the boom cylinder 3*a*) and outputs the target pump pressure Psd to the difference calculation section 82.

The difference calculation section 82 calculates the difference between the target pump pressure Psd described above and the pressure in the hydraulic fluid supply line 5 (actual pump pressure Ps) detected by the pressure sensor 42 as ΔP (=Psd−Ps) and outputs ΔP to the main pump target tilting angle computing section 83.

In the main pump target tilting angle computing section 83, the table 83*a* converts the differential pressure ΔP into the increment or decrement of the target capacity Δq. In the case of performing the boom raising operation from the state in which all the levers are neutral, the actual pump pressure Ps is kept to the value smaller than the target pump pressure Psd in the beginning of the operation (as described in (a) In a case in which all levers are neutral); thus, the differential pressure ΔP (=Psd−Ps) is a positive value.

Since the table 83*a* has characteristics such that the target capacity increment or decrement Δq is positive in the case in which the differential pressure ΔP is the positive value, the target capacity increment or decrement Δq is also positive.

The addition section 83*b* and the delay element 83*c* add the target capacity increment or decrement Δq to the target capacity q' one control step before to calculate the new target capacity q. Since the target capacity increment or decrement Δq is positive as described above, the target capacity q' increases.

Furthermore, the target capacity q' is converted into the command pressure Pi_fc to the solenoid proportional pressure reducing valve 21 by the table 83*e*, and the output (Pi_fc) from the solenoid proportional pressure reducing valve 21 is sent to the pressure receiving section 11*h* of the flow control tilting control valve 11*i* within the regulator 11 of the main pump 2, and the tilting angle of the main pump 2 is controlled to be equal to the target capacity q'.

Increases in the target capacity q' and the delivery amount from the main pump 2 continue until the actual pump pressure Ps is equal to the target pump pressure Psd, and the actual pump pressure Ps is eventually kept into a state of being equal to the target pump pressure Psd.

In this way, the main pump 2 increases or decreases the flow rate while setting the pressure obtained by adding the pressure loss ΔPsd possibly generated in the meter-in opening of the directional control valve 6*a* for controlling the boom cylinder 3*a* to the highest load pressure Pl max as the target pressure; thus, load sensing control is exercised with the target differential pressure variable.

(c) In a Case of Simultaneously Performing a Boom Raising Operation and an Arm Crowding Operation The boom raising operating pressure a is output from the pilot valve of the boom operation lever device 60*a* and the arm crowding operating pressure c is output from the pilot valve of the arm operation lever device 60*b*. The boom raising operating pressure a is introduced to the directional control valve 6*a* and the pressure sensor 41*a*, and the directional control valve 6*a* is changed over to the right direction in the drawing. The arm crowding operating pressure c is introduced to the directional control valve 6*b* and the pressure sensor 41*c*, and the directional control valve 6*b* is changed over to the right direction in the drawing.

The boom raising operating pressure a is input, as the output Pi_a from the pressure sensor 41*a*, to the demanded flow rate computing section 72, and the demanded flow rate Qr1 is calculated.

The arm crowding operating pressure c is input, as the output Pi_c from the pressure sensor 41*c*, to the demanded flow rate computing section 72, and the demanded flow rate Qr2 is calculated.

While the main pump actual flow rate computing section 71 calculates the flow rate of the hydraulic fluid actually delivered from the main pump 2 in response to the inputs from the tilting angle sensor 50 and the revolution speed sensor 51, the tilting of the main pump 2 is kept to the minimum and the main pump actual flow rate Qa' is also the minimum value right after boom raising and arm crowding operations are performed from the state in which all the operation levers are neutral, as described in (a) In a case in which all operation levers are neutral.

In the demanded flow rate correction section 73, the boom raising demanded flow rate Qr1 and the arm crowding demanded flow rate Qr2 are sent to the summing section 73*a*, and the summing section 73*a* calculates Qra (=Qr1+Qr2+Qr3=Qr1+Qr2).

Qra calculated by the summing section 73*a* is limited to the value in a certain range by the limiting section 73*f*; the divider section 73*b* then divides the main pump actual flow rate Qa' that is the output from the main pump actual flow rate computing section 71 by Qra, that is, performs Qa'/Qra, and an output from the divider section 73*b* is sent to the multiplier sections 73*c*, 73*d*, and 73*e*.

In other words, the demanded flow rate correction section 73 re-distributes the boom raising demanded flow rate Qr1 and the arm crowding demanded flow rate Qr2 at a ratio of Qr1 to Qr2 in a range of the flow rate Qa' of the hydraulic fluid actually delivered from the main pump 2.

In a case, for example, in which Qa' is 30 L/min, Qr1 is 20 L/min, and Qr2 is 40 L/min, Qa'/Qra=½ since Qra=Qr1+Qr2+Qr3=60 L/min.

A corrected boom raising demanded flow rate is Qr1'=Qr1×½=20 L/min×½=10 L/min, and a corrected arm crowding demanded flow rate is Qr2'=Qr2×½=40 L/min×½=20 L/min.

Furthermore, the boom raising operating pressure a and the arm crowding operating pressure c are also introduced, as the outputs Pi_a and Pi_c from the pressure sensors 41*a* and 41*c*, to the meter-in opening computing section 74, and converted into the meter-in opening areas Am1 and Am2 by the tables 74*a* and 74*b*, and the meter-in opening areas Am1 and Am2 are output.

On the other hand, the load pressure of the boom cylinder 3*a* is introduced to the pressure sensor 40*a* and the shuttle valve 9*a* through the directional control valve 6*a*, and the load pressure of the arm cylinder 3*b* is introduced to the pressure sensor 40*b* and the shuttle valve 9*a* through the directional control valve 6*b*.

The shuttle valve 9*a* selects the higher pressure out of the load pressures of the boom cylinder 3*a* and the arm cylinder 3*b* as the highest load pressure Pl max. In a case of assuming that the hydraulic excavator acts in midair, the load pressure of the boom cylinder 3*a* is normally, often higher than the load pressure of the arm cylinder 3*b*. In a case of assuming that the load pressure of the boom cylinder 3*a* is higher than the load pressure of the arm cylinder 3*b*, the highest load pressure Pl max is equal to the load pressure of the boom cylinder 3*a*.

The highest load pressure Pl max is introduced to the pressure receiving section 15*a* of the unloading valve 15.

The load pressures of the boom cylinder 3*a* and the arm cylinder 3*b* are introduced, as the outputs Pl1 and Pl2 from the pressure sensors 40*a* and 40*b*, to the maximum value selection section 75, the flow rate control valve opening computing section 76, and the highest load pressure actuator determination section 77.

The maximum value selection section 75 outputs the higher load pressure out of the load pressures of the boom cylinder 3*a* and the arm cylinder 3*b* as the highest load pressure Pl max. Since the case in which the load pressure Pl1 of the boom cylinder 3*a* is higher than the load pressure Pl2 of the arm cylinder 3*b* is considered herein as described above, the highest load pressure Pl max=Pl1.

In the flow rate control valve opening computing section 76, first, the difference calculation sections 76*a*, 76*b*, and 76*c* compute the differences between the highest load pressure Pl max and the load pressures Pl1, Pl2, and Pl3 of the actuators.

In the case in which the boom raising and the arm crowding are simultaneously operated and the load pressure of the boom cylinder 3*a* is higher than the load pressure of the arm cylinder 3*b*, the difference between the highest load pressure Pl max and the load pressure Pl1 of the boom cylinder 3*a* is expressed by Pl max−Pl1=0. The limiting section 76*d* keeps the difference Pl max−Pl1 to the minimum value as close to preset 0 as possible, and the difference is input to the computing section 76*g* as ΔPl1. Qr1' output from the demanded flow rate correction section 73 is also input to the computing section 76*g*. However, in the case of the sole boom raising operation, ΔPl1 is quite a small value as described above; thus, the output A1 from the computing section 76*g* calculated by the following Equation is equal to a large value closer to an infinity.

$$A1 = \frac{Qr1'}{C} \cdot \sqrt{\frac{\rho}{2 \cdot \Delta Pl1}} \quad \text{[Math. 5]}$$

On the other hand, the difference Pl max−Pl2 between the highest load pressure Pl max and the load pressure Pl2 of the arm cylinder 3*b* is a certain value greater than 0. Pl max−Pl2 is input, as ΔPl2, together with the corrected demanded flow rate Qr2' to computing section 76*h* through the limiting section 76*e*, and the target opening area A2 of the flow control valve 7*b* is computed by the following Equation.

$$A2 = \frac{Qr2'}{C} \cdot \sqrt{\frac{\rho}{2 \cdot \Delta Pl2}} \quad \text{[Math. 6]}$$

In this way, the target opening area A2 of the flow control valve 7*b* associated with the arm cylinder 3*b* is computed to a uniquely determined value to generate the differential pressure between the highest load pressure Pl max and the load pressure Pl2 of the arm cylinder 3*b* in a case in which the hydraulic fluid flows at the corrected demanded flow rate Qr2' of the arm crowding.

The opening areas A1 and A2 of the flow control valves 7*a* and 7*b* are converted into the command pressures Pi_a1 and Pi_a2 to the solenoid proportional pressure reducing valves 20*a* and 20*b* by the tables 76*j* and 76*k*. Since A1 is the large value closer to the infinity as described above, Pi_a1 is kept to the maximum value and the flow control valve 7*a* controlled by the flow control valve solenoid proportional pressure reducing valve 20*a* is also kept to the maximum opening. On the other hand, A2 is kept to the opening to generate the differential pressure between the highest load pressure Pl max and Pl2 as described above.

This actuation is a motion simulating an actuation of the pressure compensating valve in the conventional load sensing system.

In other words, the differential pressures across the directional control valves 6*a* and 6*b* controlling the boom cylinder 3*a* and the arm cylinder 3*b* are set as follows. The opening of the flow control valve associated with the actuator having the lower load (arm cylinder 3*b* in the present case) is controlled to generate the differential pressure between the highest load pressure Pl max and that of the arm cylinder 3*b*. As a result, the differential pressures across the directional control valves 6*a* and 6*b* controlling the boom cylinder 3*a* and the arm cylinder 3*b* are equal to each other, and the hydraulic fluid is diverted to the boom cylinder 3*a* and the arm cylinder 3*b* in response to the meter-in openings of the directional control valves 6*a* and 6*b*.

In this way, the hydraulic fluid delivered from the variable displacement main pump 2 is supplied to the bottom side of the boom cylinder 3*a* through the hydraulic fluid supply line 5, the flow control valve 7*a*, the check valve 8*a*, and the directional control valve 6*a*, and supplied to the bottom side of the arm cylinder 3*b* through the hydraulic fluid supply line 5, the flow control valve 7*b*, the check valve 8*b*, and the directional control valve 6*b*, and the boom cylinder 3*a* and the arm cylinder 3*b* are expanded.

Furthermore, the flow rate control valve opening computing section 76 similarly calculates the opening area A3 of the flow control valve 7*c*. In the case of not operating swing, the load pressure Pl3 of the swing motor 3*c* is equal to the tank pressure; thus, Pl max−Pl3 calculated by the difference calculation section 76*c* is equal to Pl max. On the other hand, the corrected demanded flow rate Qr3' input from the demanded flow rate correction section 73 is 0; thus, A3 output from the computing section 76*i* is equal to 0. A3 is converted into the command pressure Pi_a3 to the solenoid proportional pressure reducing valve 20*c* by the table 76*l*. Since A3 is equal to 0 as described above, Pi_a3 is equal to the tank pressure and the flow control valve 7*c* is kept in a fully closed state.

In the case in which the load pressure Pl1 of the boom cylinder 3*a* is higher than the load pressure Pl2 of the arm cylinder 3*b*, Pl max−Pl1=0. Therefore, in the highest load pressure actuator determination section 77, the determination section 77*d* introduces i=1 to the summing section 77*m*. On the other hand, the determination sections 77*e* and 77*f* both send i=0 to the summing section 77*m*.

The summing section 77*m* outputs 1, as the identifier i, to the highest load pressure actuator directional control valve meter-in opening computing section 78 and the highest load pressure actuator corrected demanded flow rate computing section 79.

In the highest load pressure actuator directional control valve meter-in opening computing section 78, the determination section 78*a* selects Am1 as the meter-in opening area Ami and outputs the Am1 to the summing section 78*j*. Furthermore, the determination sections 78*b* and 78*c* select 0 as the meter-in opening area Ami and output 0 to the summing section 78*j*. As a result, Am1+0+0=Am1 is output as the directional control valve meter-in opening area Ami of the highest load pressure actuator.

Moreover, in the highest load pressure actuator corrected demanded flow rate computing section 79, the determination section 79*a* selects Qr1' as Qri' and outputs Qr1' to the summing section 79*j*. Furthermore, the determination sections 79*b* and 79*c* both select 0 as Qri' and output 0 to the summing section 79*j*. As a result, Qr1'+0+0=Qr1' is output as the corrected demanded flow rate Qri' of the highest load pressure actuator.

The meter-in opening area Am1 output from the highest load pressure actuator directional control valve meter-in opening computing section 78 and the corrected demanded flow rate Qr1' output from the highest load pressure actuator corrected demanded flow rate computing section 79 are sent to the target differential pressure computing section 80.

In the target differential pressure computing section 80, Am1 and Qr1' are sent to the computing section 80*a*, and the computing section 80*a* perform computing illustrated in the following Equation and outputs the target differential pressure ΔPsd.

$$\Delta Psd = \frac{\rho}{2} \cdot \frac{(Qr1')^2}{C^2 \cdot (Am1)^2} \quad \text{[Math. 7]}$$

The target differential pressure ΔPsd output from the computing section 80*a* is limited to the value in a certain range by the limiting section 80*d* and converted into the command pressure Pi_ul to the solenoid proportional pressure reducing valve 22 by the table 80*b*.

The output ΔPsd from the solenoid proportional pressure reducing valve 22 is introduced to the pressure receiving section 15*c* of the unloading valve 15 and functions to increase the set pressure of the unloading valve 15 by ΔPsd.

As described above, the load pressure Pl1 of the boom cylinder 3*a* is introduced as Pl max to the pressure receiving section 15*a* of the unloading valve 15. Owing to this, the set pressure of the unloading valve 15 is set to Pl max+ΔPsd+spring force, that is, Pl1 (load pressure of the boom cylinder 3*a*)+ΔPsd (differential pressure generated in the meter-in opening of the directional control valve 6*a* for controlling the boom cylinder 3*a*)+spring force, and the unloading valve 15 interrupts a hydraulic line through which hydraulic fluid from the hydraulic line 5 is discharged to the tank.

On the other hand, the target differential pressure ΔPsd limited to the certain range by the limiting section 80*d* is output to the addition section 81.

The addition section 81 adds up the highest load pressure Pl max and the difference ΔPsd to calculate the target pump pressure Psd=Pl max+ΔPsd. In the case in which the boom raising and the arm crowding are simultaneously operated and the load pressure of the boom cylinder 3*a* is higher than the load pressure of the arm cylinder 3*b*, Pl max=Pl1 as described above; thus, the addition section 81 calculates the target pump pressure Psd=Pl1 (load pressure of the boom cylinder 3*a*)+ΔPsd (differential pressure generated in the meter-in opening of the directional control valve 6*a* for controlling the boom cylinder 3*a*) and outputs the target pump pressure Psd to the difference calculation section 82.

The difference calculation section 82 calculates the difference between the target pump pressure Psd described above and the pressure in the hydraulic fluid supply line 5 (actual pump pressure Ps) detected by the pressure sensor 42 as ΔP (=Psd−Ps) and outputs ΔP to the main pump target tilting angle computing section 83.

In the main pump target tilting angle computing section 83, the table 83*a* converts the target pump differential pressure ΔP into the increment or decrement of the target capacity Δq. In the case of simultaneously operating the boom raising and the arm crowding from the state in which all the levers are neutral, the actual pump pressure Ps is kept to the value smaller than the target pump pressure Psd in the beginning of the action (as described in (a) In a case in which all levers are neutral); thus, the differential pressure ΔP (=Psd−Ps) is a positive value.

Since the table 83*a* has characteristics such that the target capacity increment or decrement Δq is positive in the case in which the differential pressure ΔP is the positive value, the target capacity increment or decrement Δq is also positive.

The addition section 83*b* and the delay element 83*c* add the target capacity increment or decrement Δq to the target capacity q' one control step before to calculate the new target capacity q. Since the target capacity increment or decrement Δq is positive as described above, the target capacity q' increases.

Furthermore, the target capacity q' is converted into the command pressure Pi_fc to the solenoid proportional pressure reducing valve 21 by the table 83*e*, and the output Pi_fc from the solenoid proportional pressure reducing valve 21 is introduced to the pressure receiving chamber of the flow control tilting control valve 11*i* within the regulator 11 of the main pump 2, and the tilting angle of the main pump 2 is controlled to be equal to the target capacity q'.

Increases in the target capacity q' and the delivery amount from the main pump 2 continue until the actual pump pressure Ps is equal to the target pump pressure Psd, and the actual pump pressure Ps is eventually kept into a state of being equal to the target pump pressure Psd.

In this way, the main pump 2 increases or decreases the flow rate while setting the pressure obtained by adding the pressure loss ΔPsd, the highest load pressure actuator, possibly generated in the meter-in opening of the directional control valve 6*a* for controlling the boom cylinder 3*a* to the highest load pressure Pl max as the target pressure; thus, load sensing control is exercised with the target differential pressure variable.

~Advantages~

According to Embodiment 1, the following advantages are obtained.

1. According to Embodiment 1, the controller 70 is configured to compute the demanded flow rates of the plurality of directional control valves 6*a*, 6*b*, and 6*c* and the differential pressures between the highest load pressure and the load pressures of the plurality of actuators 3*a*, 3*b*, and 3*c*, compute the target opening areas of the plurality of flow control valves 7*a*, 7*b*, and 7*c* on the basis of the demanded flow rates and the differential pressures, and control the opening areas of the plurality of flow control valves 7*a*, 7*b*, and 7*c* in such a manner that the opening areas are equal to the target opening areas. Thus the openings of the flow control valves 7*a*, 7*b*, and 7*c* associated with the actuators 3*a*, 3*b*, and 3*c* are controlled to be equal to the values uniquely determined by the demanded flow rate of the main pump (hydraulic pump) 2 computed from the input amounts of the operation levers at the time and the differential pressures between the highest load pressure and the load pressures of the actuators 3*a*, 3*b*, and 3*c*, without hydraulic feedback of the differential pressures across the meter-in openings of the directional control valves 6*a*, 6*b*, and 6*c* associated with the actuators 3*a*, 3*b*, and 3*c*. As a result, even in a case in which the differential pressure (meter-in pressure loss) across each of the directional control valves 6*a*, 6*b*, and 6*c* associated with the actuators 3*a*, 3*b*, and 3*c* is very low, flow dividing control of the plurality of directional control valves 6*a*, 6*b*, and 6*c* can be performed in a stable state.

2. Further, according to Embodiment 1, the controller 70 is configured to compute the meter-in opening areas of the plurality of directional control valves 6*a*, 6*b*, and 6*c* on the basis of the input amounts of the operation levers, compute the meter-in pressure loss of the directional control valve associated with the highest load pressure actuator (specific directional control valve) among the plurality of directional control valves 6*a*, 6*b*, and 6*c* on the basis of the opening area of the directional control valve (specific directional control valve) and the demanded flow rate of the directional control valve (specific directional control valve), and output this pressure loss as the target differential pressure ΔPsd to control the set pressure (Pl max+ΔPsd+spring force) of the unloading valve 15. Thus, the set pressure of the unloading valve 15 is controlled to be equal to the value determined by adding the target differential pressure ΔPsd and the spring force to the highest load pressure, and therefore, in the case of throttling the meter-in opening of the directional control valve associated with the highest load pressure actuator (specific directional control valve) by a half operation of the operation lever, the set pressure of the unloading valve 15 is finely controlled in response to the pressure loss of the meter-in opening of the directional control valve. As a result, even in the case in which a demanded flow rate suddenly changes at the time of transition from a combined operation including a half operation of the operation lever corresponding to the directional control valve associated with the highest load pressure actuator, to a single half operation, and the pump pressure suddenly rises due to insufficient responsiveness of pump flow control, a bleed-off loss of useless discharge of the hydraulic fluid from the unloading valve 15 to the tank is suppressed to minimum and a reduction in energy efficiency is suppressed, and further a sudden change in each actuator speed caused by an abrupt change in a flow rate of the hydraulic fluid supplied to each actuator is prevented and occurrence of an unpleasant shock is suppressed, thereby to realize excellent combined operability.

3. Moreover, according to Embodiment 1, as described above, since even in the case in which the differential pressures across the directional control valves 6*a*, 6*b*, and 6*c* are very low, flow dividing control of the plurality of directional control valves 6*a*, 6*b*, and 6*c* can be performed in a stable state and the set pressure of the unloading valve 15 is finely controlled in response to the pressure loss of the meter-in opening of the directional control valve 6*a*, 6*b*, and 6*c*, it is possible to set extremely large the meter-in final openings (meter-in opening area in a full stroke of each main spool) of the directional control valves 6*a*, 6*b*, and 6*c*, and therefore a meter-in loss in each of the directional control valves 6*a*, 6*b*, and 6*c* can be reduced to realize high energy efficiency.

4. In the conventional load sensing control as described in Patent Document 1, the hydraulic pump increases or decreases the delivery flow rate of the hydraulic fluid from the hydraulic pump in such a manner that the LS differential pressure is equal to the preset target LS differential pressure. However, in the case of setting the meter-in final opening of each main spool extremely large as described above, the LS differential pressure nearly equals 0. The conventional load sensing control has, therefore, problems that the hydraulic pump delivers the hydraulic fluid at the maximum flow rate within an allowable range, and that it is impossible to exercise the flow control in response to each operation lever input.

According to Embodiment 1, the controller 70 is configured to compute the target differential pressure ΔPsd for regulating the set pressure of the unloading valve 15, and control the delivery flow rate of the main pump 2 detected by the pressure sensor 42 using the target differential pressure ΔPsd in such a manner that the delivery pressure of the main pump 2 is equal to the pressure obtained by adding the target differential pressure ΔPsd to the highest load pressure. Owing to this, even if the meter-in final openings of the directional control valves 6*a*, 6*b*, and 6*c* are set extremely large, then the problem that it is impossible to exercise the pump flow control does not occur differently from the case of setting the LS differential pressure to 0 in the conventional load sensing control, and it is possible to control the delivery flow rate of the hydraulic fluid from the main pump 2 in response to each operation lever input.

5. Moreover, the main pump 2 exercises the load sensing control in the light of the meter-in pressure loss of the directional control valve associated with the highest load pressure actuator, and the hydraulic fluid necessary for each actuator is delivered from the main pump 2 in proper amounts under the pump flow control in response to the input of each operation lever; thus, it is possible to realize a hydraulic system with high energy efficiency, compared with the flow control for determining the target flow rate simply in response to each operation lever input.

Embodiment 2

A hydraulic drive system provided in a construction machine according to Embodiment 2 of the present invention will be described hereinafter while mainly referring to different parts from those according to Embodiment 1.

~Structure~

Figure 16:
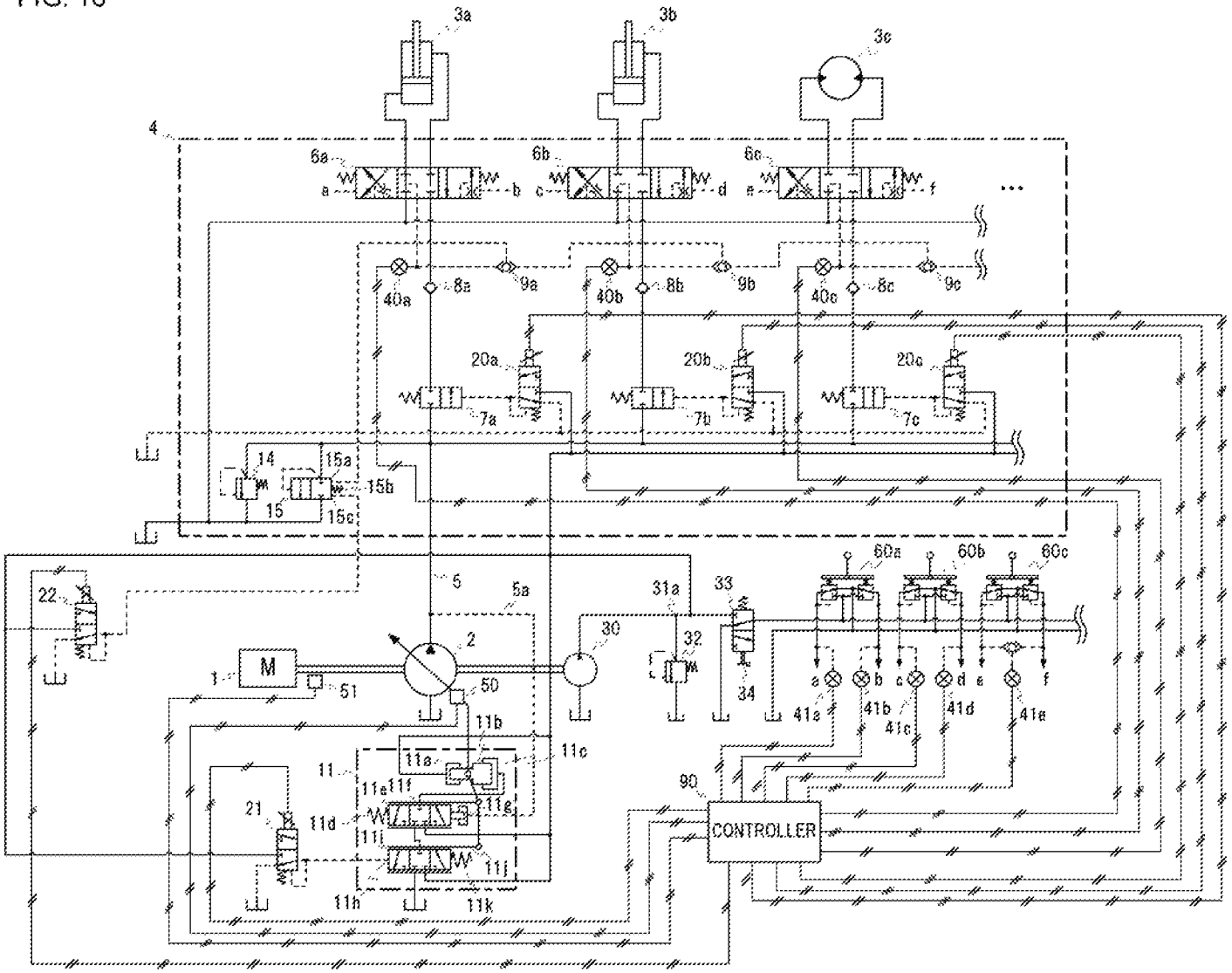
FIG. 16 is a diagram depicting a structure of a hydraulic drive system provided in a construction machine according to Embodiment 2 of the present invention.

FIG. 16 is a diagram depicting a structure of the hydraulic drive system provided in the construction machine according to Embodiment 2.

In FIG. 16, the hydraulic drive system according to Embodiment 2 is configured in such a manner that the pressure sensor 42 for detecting the pressure in the hydraulic fluid supply line 5, that is, the pump pressure is eliminated and a controller 90 is provided as an alternative to the controller 70, compared with the hydraulic drive system according to Embodiment 1.

Figure 17:
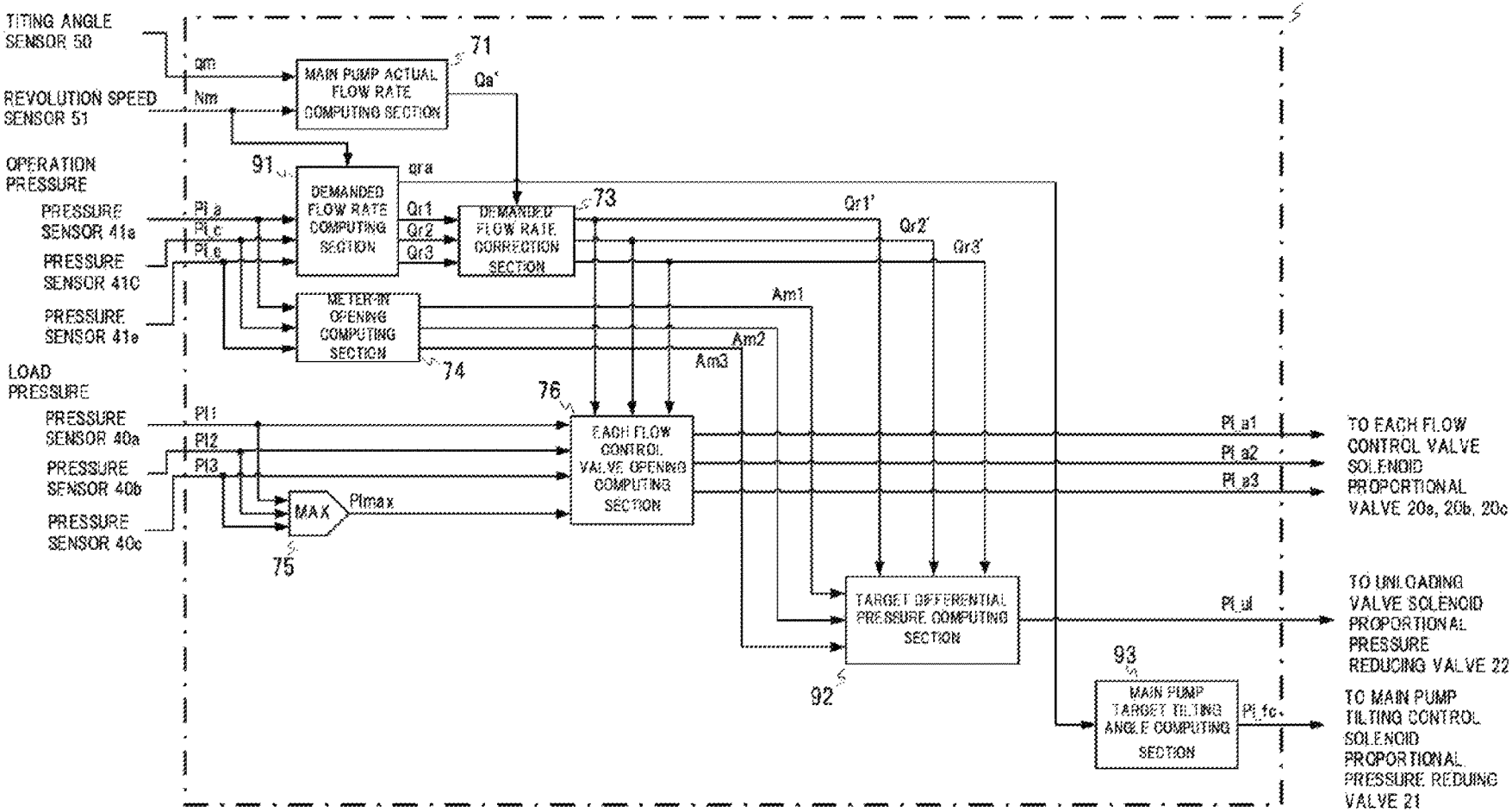
FIG. 17 is a functional block diagram of a controller in the hydraulic drive system according to Embodiment 2.

FIG. 17 depicts a functional block diagram of the controller 90 according to Embodiment 2.

In FIG. 17, parts different from those in Embodiment 1 depicted in FIG. 5 are a demanded flow rate computing section 91, a target differential pressure computing section 92, and a main pump target tilting angle computing section 93.

In the target differential pressure computing section 92, the controller 90 is configured to select, as the meter-in pressure loss of the specific directional control valve, the maximum value of the meter-in pressure losses of the plurality of directional control valves 6*a*, 6*b*, and 6*c*, and output this pressure loss as the target differential pressure ΔPsd to control the set pressure of the unloading valve 15.

In the demanded flow rate computing section 91 and the main pump target tilting angle computing section 93, the controller 90 is configured to calculate the sum of the demanded flow rates of the plurality of actuators 3*a*, 3*b*, and 3*c* on the basis of the input amounts of the operation levers of the plurality of operation lever devices 60*a*, 60*b*, and 60*c*, compute the command value Pi_fc for making the delivery flow rate of the hydraulic fluid from the main pump 2 (hydraulic pump) equal to the sum of the demanded flow rates, and output the command value Pi_fc to the regulator 11 (pump regulating device) to control the delivery flow rate of the main pump 2.

Figure 18:
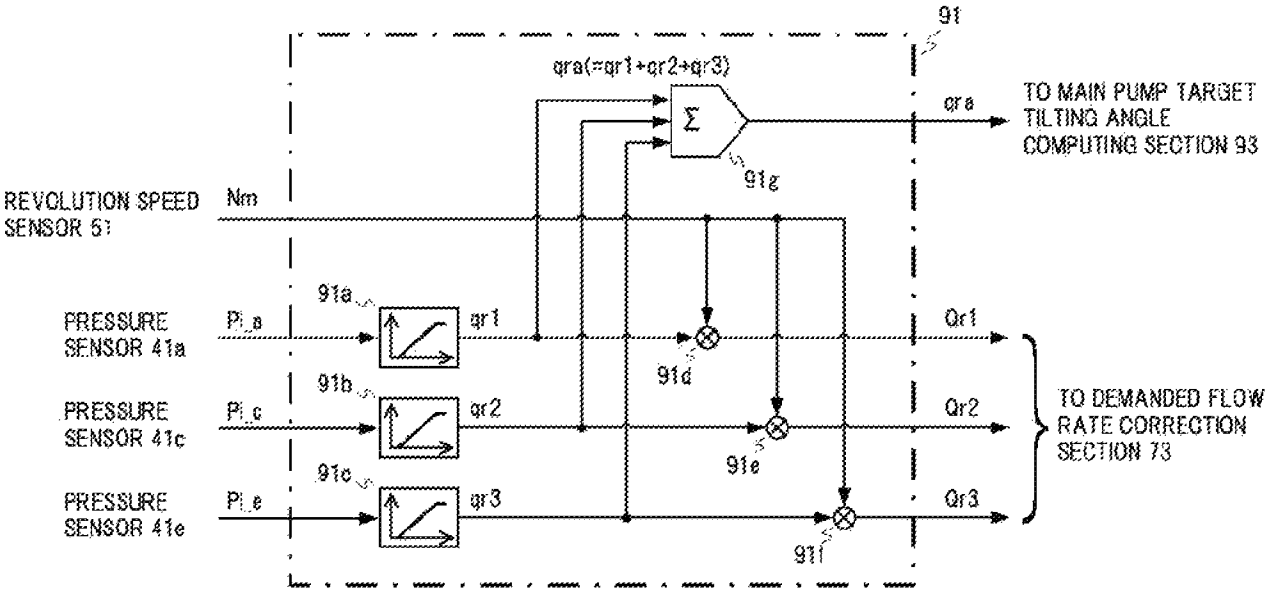
FIG. 18 is a functional block diagram of a demanded flow rate computing section in the controller.

FIG. 18 depicts a functional block diagram of the demanded flow rate computing section 91.

Tables 91*a*, 91*b*, and 91*c* convert the operating pressures Pi_a, Pi_c, and Pi_e of the operation levers input from the pressure sensors 41*a*, 41*c*, and 41*e* into demanded tilting angles (capacities) qr1, qr2, and qr3, multiplier sections 91*d*, 91*e*, and 91*f* calculate the demanded flow rates Qr1, Qr2, and Qr3 using the input Nm from the revolution speed sensor 51, and a summing section 91*g* calculates a sum of the demanded tilting angles qra (=qr1+qr2+qr3) and outputs qra to the main pump target tilting angle computing section 93.

Figure 19:
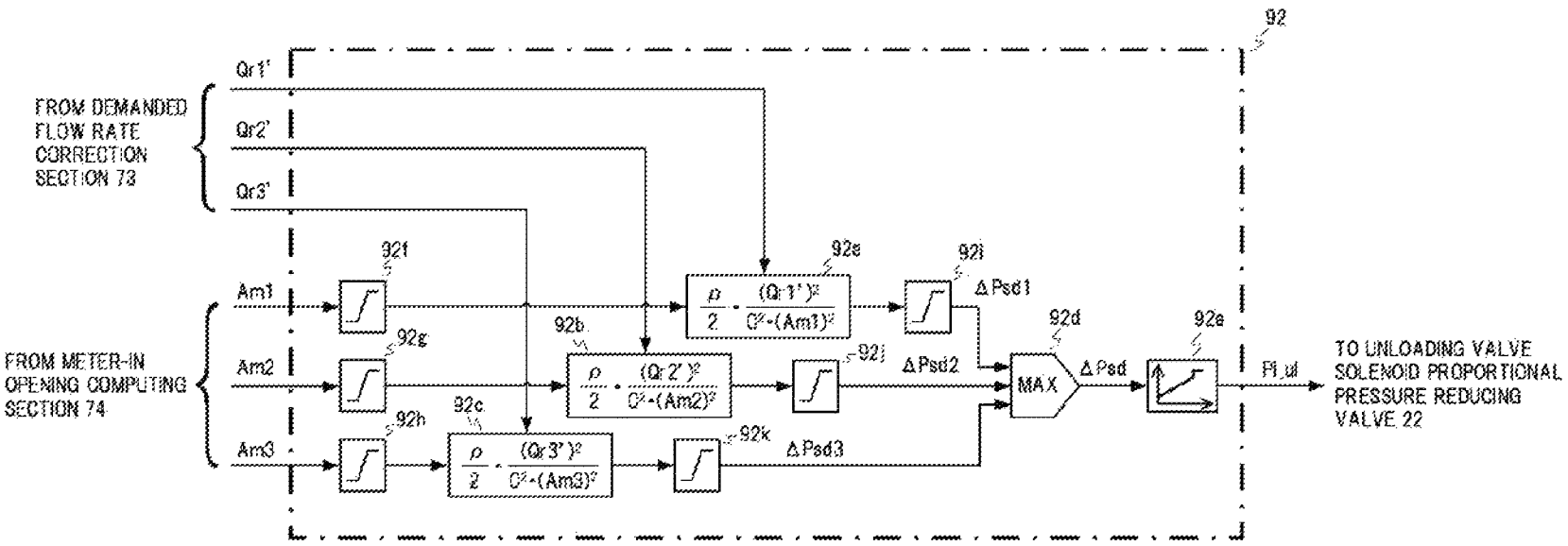
FIG. 19 is a functional block diagram of a target differential pressure computing section in the controller.

FIG. 19 depicts a functional block diagram of the target differential pressure computing section 92.

Qr1', Qr2', and Qr3' that are the inputs from the demanded flow rate correction section 73 are input to computing sections 92*a*, 92*b*, and 92*c*, respectively. Furthermore, Am1, Am2, and Am3 that are the inputs from the meter-in opening computing section 74 are input to computing sections 92*a*, 92*b*, and 92*c* through limiting sections 92*f*, 92*g*, and 92*h* each limiting minimum and maximum values, respectively. The computing sections 92*a*, 92*b*, and 92*c* compute meter-in pressure losses ΔPsd1, ΔPsd2, and ΔPsd3 of the directional control valves 6*a*, 6*b*, and 6*c* using the inputs Qr1', Qr2', and Qr3' and Am1, Am2, and Am3 by the following Equations. In Math. 8, C denotes the preset contraction coefficient and p denotes the density of the hydraulic operating fluid.

[Math. 8]

$$\Delta Psd1 = \frac{\rho}{2} \cdot \frac{(Qr1')^2}{C^2 \cdot (Am1)^2}$$

$$\Delta Psd2 = \frac{\rho}{2} \cdot \frac{(Qr2')^2}{C^2 \cdot (Am2)^2}$$

$$\Delta Psd3 = \frac{\rho}{2} \cdot \frac{(Qr3')^2}{C^2 \cdot (Am3)^2}$$

These pressure losses ΔPsd1, ΔPsd2, and ΔPsd3 are input to a maximum value selection section 92*d* through limiting sections 92*i*, 92*j*, and 92*k* each limiting minimum and maximum values, the maximum value selection section 92*d* outputs a maximum pressure loss among the meter-in pressure losses ΔPsd1, ΔPsd2, and ΔPsd3 of the directional control valves 6*a*, 6*b*, and 6*c* as the target differential pressure ΔPsd, and a table 92*e* further converts the target differential pressure ΔPsd into the command pressure (command value) Pi_ul and outputs the command value Pi_ul to the solenoid proportional pressure reducing valve 22.

Figure 20:
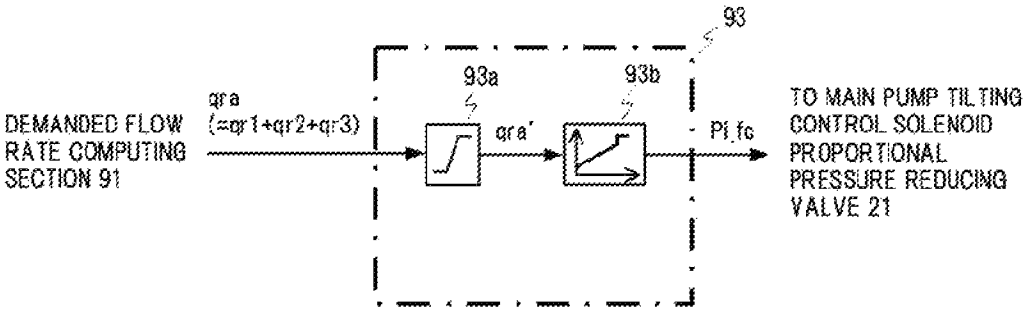
FIG. 20 is a functional block diagram of a main pump target tilting angle computing section in the controller.

FIG. 20 depicts a functional block diagram of the main pump target tilting angle computing section 93.

A limiting section 93*a* limits qra (=qr1+qr2+qr3) that is an input from the demanded flow rate computing section 91 to a value between a minimum value and a maximum value of the tilting of the main pump 2, and a table 93*b* then converts the resultant value into the command pressure Pi_fc to the solenoid proportional pressure reducing valve 21.

~Actuations~

Actuations of the hydraulic drive system according to Embodiment 2 will be described while mainly referring to parts different from those according to Embodiment 1 with reference to FIGS. 16 to 20.

First, in Embodiment 1, the highest load pressure actuator determination section 77 determines the highest load pressure actuator, and the target differential pressure computing section 80 calculates the meter-in pressure loss of the highest load pressure actuator as the overall target differential pressure ΔPsd. In Embodiment 2, by contrast, the target differential pressure computing section 92 calculates the meter-in pressure losses ΔPsd1, ΔPsd2, and ΔPsd3 of the directional control valves 6*a*, 6*b*, and 6*c* associated with the boom cylinder 3*a*, the arm cylinder 3*b*, and the swing motor 3*c*, and sets a maximum value of the pressure losses ΔPsd1, ΔPsd2, and ΔPsd3 as the entire target differential pressure ΔPsd.

The unloading valve 15 is controlled to have the set pressure determined by the target differential pressure ΔPsd, the highest load pressure Pl max, and the spring force, similarly to Embodiment 1.

Furthermore, in Embodiment 1, what is called load sensing control is exercised to control the delivery flow rate of the main pump 2 in such a manner that the pressure in the hydraulic fluid supply line 5, that is, the pump pressure is equal to the highest load pressure Pl max+the meter-in pressure loss of the highest load pressure actuator. In Embodiment 2, by contrast, the main pump target tilting angle computing section 93 determines the delivery flow rate of the main pump 2 only by the demanded tilting angle qra determined only by the input amounts of the operation levers.

~Advantages~

According to Embodiment 2, the following advantages are obtained.

1. Similarly to Embodiment 1, since the openings of the flow control valves 7*a*, 7*b*, and 7*c* associated with the actuators 3*a*, 3*b*, and 3*c* are controlled to be equal to the values uniquely determined by the input amounts of the operation levers, the demanded flow rate of the main pump (hydraulic pump) 2 at the time, and the differential pressures between the highest load pressure and the load pressures of the actuators 3*a*, 3*b*, and 3*c*, without hydraulic feedback of the differential pressures across the meter-in openings of the directional control valves 6*a*, 6*b*, and 6*c* associated with the actuators 3*a*, 3*b*, and 3*c*, even in a case in which the differential pressure (meter-in pressure loss) across each of the directional control valves 6*a*, 6*b*, and 6*c* associated with the actuators 3*a*, 3*b*, and 3*c* is very low, flow dividing control of the plurality of directional control valves 6*a*, 6*b*, and 6*c* can be performed in a stable state.

2. Moreover, since even in the case in which the differential pressures across the directional control valves 6*a*, 6*b*, and 6*c* are very low as described above, flow dividing control of the plurality of directional control valves 6*a*, 6*b*, and 6*c* can be performed in a stable state, and the set pressure of the unloading valve 15 is finely controlled in response to the pressure losses of the meter-in openings of the directional control valves 6*a*, 6*b*, and 6*c*, it is possible to set extremely large the meter-in final openings (meter-in opening area in a full stroke of each main spool) of the directional control valves 6*a*, 6*b*, and 6*c*, and therefore a meter-in loss in each of the directional control valves 6*a*, 6*b*, and 6*c* can be reduced to realize high energy efficiency.

3. Furthermore, the following advantage similar to Advantage 2 of Embodiment 1 is obtained.

The controller 90 is configured to compute the meter-in pressure losses of the directional control valves 6*a*, 6*b*, and 6*c* associated with the actuators 3*a*, 3*b*, and 3*c*, select the maximum value of the meter-in pressure losses (computes the meter-in pressure loss of the specific directional control valve), and output this pressure loss that is the maximum value as the target differential pressure ΔPsd to variably control the set pressure (Pl max+ΔPsd+spring force) of the unloading valve 15. Thus, the set pressure of the unloading valve 15 is controlled to be equal to the value determined by adding the target differential pressure ΔPsd and the spring force to the highest load pressure; and therefore, even in a case, for example, of throttling the meter-in opening of the directional control valve associated with the actuator that is not the highest load pressure actuator to be extremely small, the set pressure of the unloading valve 15 is finely controlled in response to the pressure loss of the meter-in opening of the directional control valve. As a result, even in the case in which the demanded flow rate suddenly changes at the time of transition from a combined operation including a half operation of the operation lever corresponding to the directional control valve associated the maximum meter-in loss, to a single half operation, and the pump pressure suddenly rises due to insufficient responsiveness of pump flow control, a bleed-off loss of useless discharge of the hydraulic fluid from the unloading valve 15 to the tank is suppressed to minimum and a reduction in energy efficiency is suppressed, and further a sudden change in each actuator speed caused by an abrupt change in the flow rate of the hydraulic fluid supplied to each actuator is prevented and occurrence of an unpleasant shock is suppressed, thereby to realize excellent combined operability.

4. Moreover, since the main pump 2 exercises flow control to calculate the sum of the demanded flow rates of the plurality of directional control valves 6*a*, 6*b*, and 6*c* and to determine the target flow rate on the basis of the input amounts of the operation levers, it is possible to realize a stable hydraulic system, compared with the case of exercising the load sensing control that is a kind of feedback control as illustrated in Embodiment 1. Furthermore, it is possible to omit the pressure sensor for detecting the pump pressure and to reduce a cost of the hydraulic system.

<Others>

While the spring 15*b* stabilizing the operation of the unloading valve 15 is provided in Embodiments 1 and 2 described above, it is not always necessary to provide the spring 15*b*. Furthermore, the value of "ΔPsd+spring force" may be computed within the controller 70 or 90 as the target differential pressure without providing the spring 15*b* in the unloading valve 15.

Moreover, in Embodiment 2, the pump regulating device exercising the load sensing control may be used similarly to Embodiment 1. In Embodiment 1, the pump regulating device calculating the sum of demanded flow rates of the plurality of directional control valves 6*a*, 6*b*, and 6*c* and exercising the flow control may be used similarly to Embodiment 2.

Moreover, while the case in which the construction machine is the hydraulic excavator having the crawler belts provided in the lower travel structure has been described in Embodiments 1 and 2, the construction machine may be other than the hydraulic excavator, for example, may be a wheel type hydraulic excavator, a hydraulic crane, or the like. In that case, similar advantages can be obtained.

DESCRIPTION OF REFERENCE CHARACTERS

1: Prime mover
2: Variable displacement main pump (hydraulic pump)
3*a* to 3*h*: Actuator
4: Control valve block
5: Hydraulic fluid supply line (main)
6*a* to 6*c*: Directional control valve (control valve device)
7*a* to 7*c*: Flow control valve (control valve device)
8*a* to 8*c*: Check valve
9*a* to 9*c*: Shuttle valve (highest load pressure sensor)
11: Regulator (pump regulating device)
14: Relief valve
15: Unloading valve
15*a*, 15*c*: Pressure receiving section
15*b*: Spring
20*a* to 20*c*, 21, 22: Solenoid proportional pressure reducing valve
30: Pilot pump
31*a*: Hydraulic fluid supply line (pilot)
32: Pilot relief valve
40*a* to 40*c*, 41*a* to 41*e*, 42: Pressure sensor
60*a* to 60*c*: Operation lever device
70, 90: Controller

The invention claimed is:

1. A construction machine provided with a hydraulic drive system comprising:

a variable displacement hydraulic pump;

a plurality of actuators driven by a hydraulic fluid delivered from the hydraulic pump;

a control valve device that distributes and supplies the hydraulic fluid delivered from the hydraulic pump to the plurality of actuators;

a plurality of operation lever devices that instructs drive directions and speeds of the plurality of actuators, respectively;

a pump regulating device that controls a delivery flow rate of the hydraulic fluid from the hydraulic pump in such a manner that the hydraulic fluid is delivered at a flow rate to match with input amounts of operation levers of the plurality of operation lever devices;

an unloading valve that discharges the hydraulic fluid in a hydraulic fluid supply line of the hydraulic pump to a tank when a pressure in the hydraulic fluid supply line of the hydraulic pump exceeds a set pressure determined by adding at least a target differential pressure to a highest load pressure of the plurality of actuators;

a plurality of first pressure sensors that detect load pressures of the plurality of actuators, respectively; and a controller that controls the control valve device, wherein the control valve device includes a plurality of directional control valves that are changed over by the plurality of operation lever devices and are associated with the plurality of actuators so as to control the drive directions and the speeds of the actuators, respectively, and a plurality of flow control valves disposed between the hydraulic fluid supply line of the hydraulic pump and the plurality of directional control valves to control flow rates of the hydraulic fluid supplied to the plurality of directional control valves by changing opening areas of the flow control valves, respectively, and the controller is configured to:

compute demanded flow rates of the plurality of actuators on the basis of input amounts of the operation levers of the plurality of operation lever devices and compute differential pressures between a highest load pressure among load pressures of the plurality of actuators and the load pressures of the plurality of actuators, compute target opening areas of the plurality of flow control valves on the basis of the demanded flow rates of the plurality of actuators and the differential pressures and control opening areas of the plurality of flow control valves in such a manner that the opening areas are equal to the target opening areas.

2. The construction machine according to claim 1, wherein the controller is further configured to compute meter-in opening areas of the plurality of directional control valves on the basis of the input amounts of the operation levers of the plurality of operation lever devices, compute a meter-in pressure loss of a specific directional control valve out of the plurality of directional control valve on the basis of the meter-in opening areas and the demanded flow rates of the plurality of actuators, and output the pressure loss as the target differential pressure to control the set pressure of the unloading valve.

3. The construction machine according to claim 2, wherein the controller is configured to compute, as the meter-in pressure loss of the specific directional control valve, a meter-in pressure loss of a directional control valve associated with an actuator having the highest load pressure out of the plurality of directional control valves, and output the pressure loss as the target differential pressure to control the set pressure of the unloading valve.

4. The construction machine according to claim 2, wherein the controller is configured to select, as the meter-in pressure loss of the specific directional control valve, a maximum value of meter-in pressure losses of the plurality of directional control valves, and control the set pressure of the unloading valve using the pressure loss as the target differential pressure.

5. The construction machine according to claim 2, further comprising:

a second pressure sensor that detects a delivery pressure of the hydraulic pump, wherein the controller is configured to compute a command value for making the delivery pressure of the hydraulic pump detected by the second pressure sensor equal to a pressure determined by adding the target differential pressure to the highest load pressure, and output the command value to the pump regulating device to control a delivery flow rate of the hydraulic fluid from the hydraulic pump.

6. The construction machine according to claim 2, wherein the controller is configured to calculate a sum of the demanded flow rates of the plurality of actuators on the basis of the input amounts of the operation levers of the plurality of operation lever devices, compute a command value for making a delivery flow rate of the hydraulic fluid from the hydraulic pump equal to the sum of the demanded flow rates, and output the command value to the pump regulating device to control the delivery flow rate of the hydraulic fluid from the hydraulic pump.

* * * * *